US005581173A

United States Patent [19]

Yalla et al.

[11] Patent Number: 5,581,173

[45] Date of Patent: Dec. 3, 1996

[54] MICROCONTROLLER-BASED TAP CHANGER CONTROLLER EMPLOYING HALF-WAVE DIGITIZATION OF A.C. SIGNALS

[75] Inventors: Murty V. V. S. Yalla, North Seminole; Robert W. Beckwith, Clearwater; Andrew P. Craig, Largo; David C. Vescovi, North Pinellas Park; James H. Harlow, North Largo; Timothy J. Bryant, Palm Harbor, all of Fla.

[73] Assignee: Beckwith Electric Co., Inc., Largo, Fla.

[21] Appl. No.: 152,001

[22] Filed: Nov. 9, 1993

Related U.S. Application Data

[63] Continuation-in-part of Ser. No. 816,242, Dec. 31, 1991, Pat. No. 5,315,527, and Ser. No. 80,822, Jun. 24, 1993, abandoned.

[51] Int. Cl.[6] ..... G05F 1/20; G05F 1/30

[52] U.S. Cl. ..... 323/257; 307/31; 323/263; 340/646; 364/483

[58] Field of Search ..... 323/256, 257, 323/216, 260, 263; 340/646, 659, 661; 361/82; 364/483; 307/31–32

[56] References Cited

U.S. PATENT DOCUMENTS 4,419,619 12/1983 Jindrick ..... 323/257

*Primary Examiner*—Peter S. Wong
*Assistant Examiner*—Aditya Krishnan
*Attorney, Agent, or Firm*—Leo J. Aubel

[57] ABSTRACT

A microcontroller-based tap-changer controller including apparatus for keeping track of an electrically closed tap position and for automatically changing the tap setting of load tap-changing transformers and regulators; the tap-changer controller further utilizes the "keep-track" tap position to calculate the source voltage of the regulator for reverse power operations; and, a method for paralleling tap-changing transformers and regulators utilizing the circulating current of the units.

10 Claims, 42 Drawing Sheets

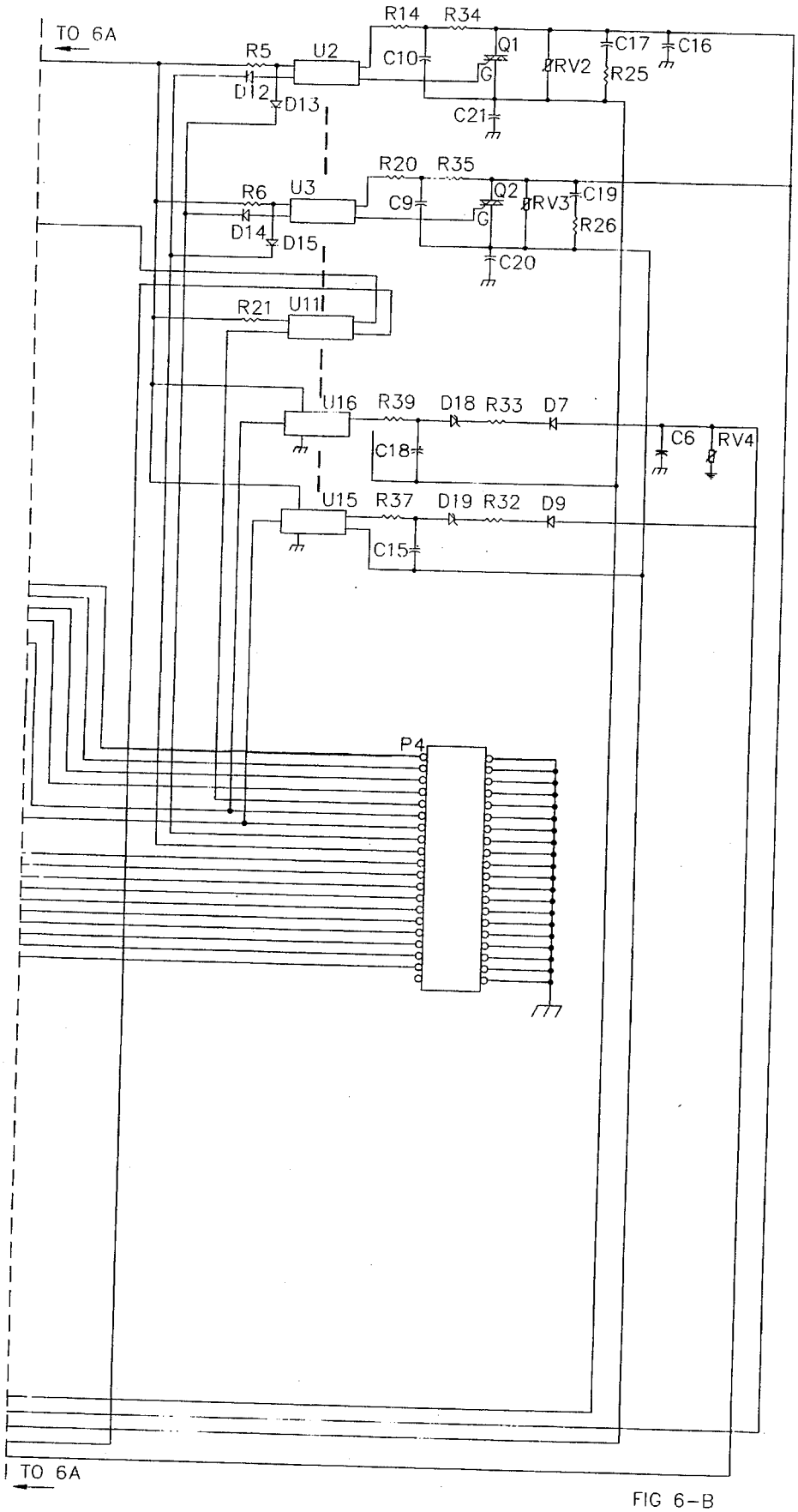
FIG 6-B

*to* Min Local Volt *Screen*

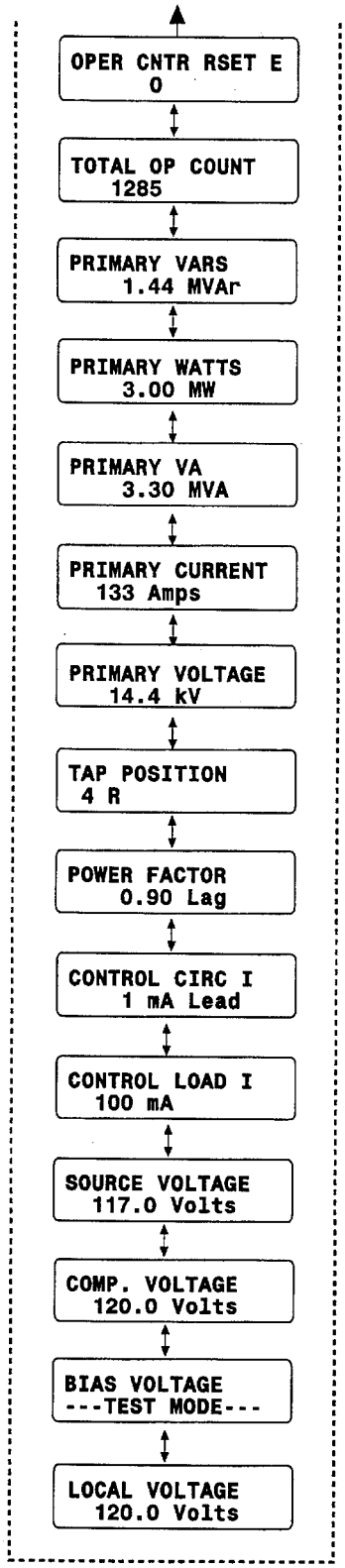

Records the total number of raise and lower operations as does the total operations counter, discussed below. This counter is reset by pressing ENTER at this screen.

Records the total number of raise and lower operations. The operation counter will advance by one or two counts, as set by user, for each open-close-open contact operation. This counter is not resettable, but can be preset to any value between 0 and 999,999.

Displays the calculated primary quantity based on the user-selected multipliers, VT configuration (line-to-line or line-to-ground), single-phase or three-phase and measured secondary voltage and current.

Displays the calculated primary current based on the user-selected current multiplier and measured secondary current.

Displays the calculated primary voltage based on the user-selected voltage multiplier and measured secondary voltage.

Displays the tap position of the tapchanger. Recognizes tapchanges commanded via manual, automatic or external (SCADA) means.

Displays the real-time calculated value of power factor.

In paralleling applications, displays the measured value of circulating current, at the circulating current input.

Displays the real-time measured value of current.

Displays the real-time calculated source voltage-only applicable in regulator control applications.

Displays the calculated voltage at the "load center".

When ENTER is pressed, the bias test voltage can be entered to test the control's automatic operation.

Displays the real-time measured value of voltage at the regulator or the transformer.

Status Screens

FIG 9-5

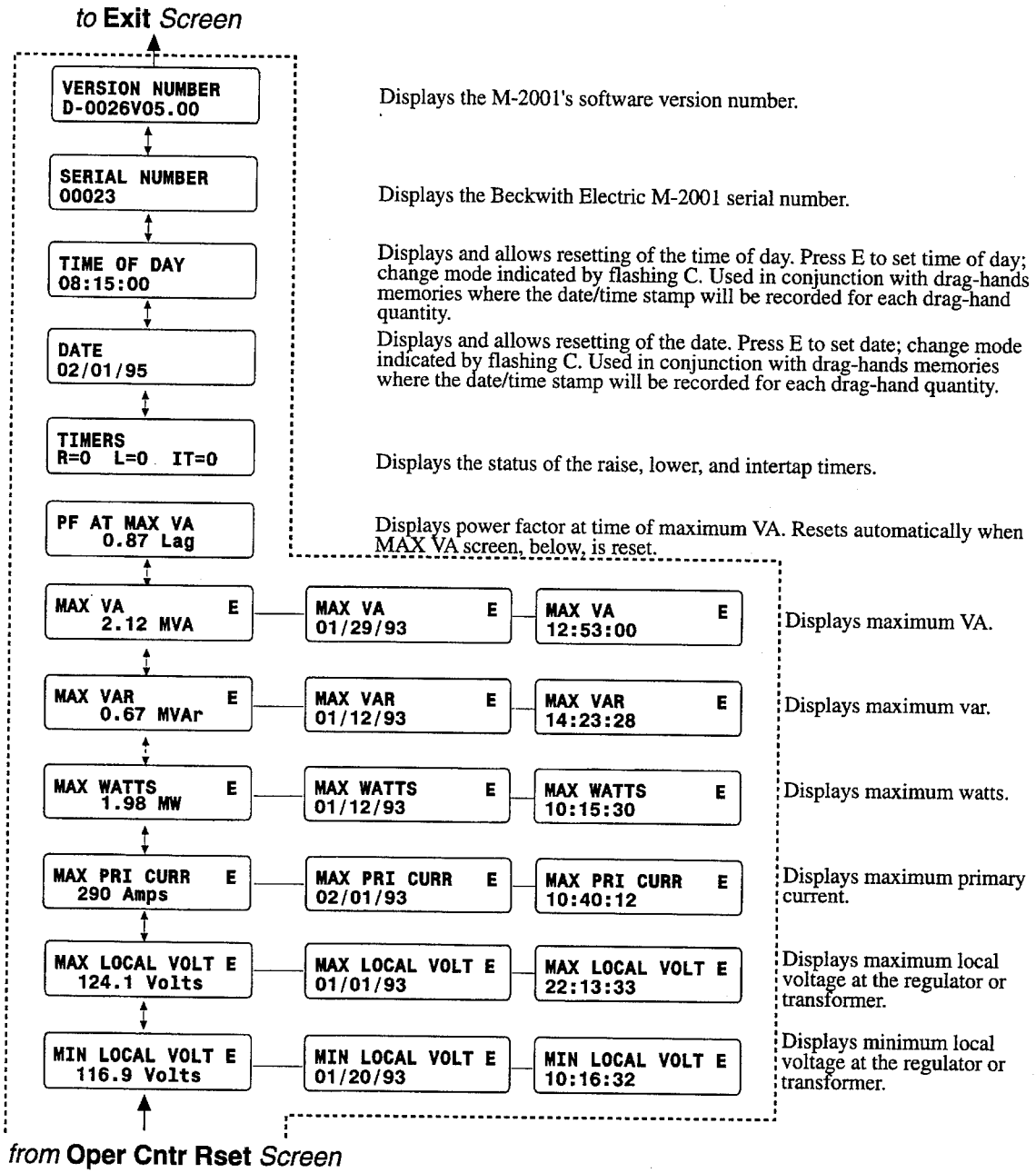

Six screens shown above indicate "drag-hand values," that is, minimum or maximum values of a parameter that are retained in non-volatile memory until reset by user. The three screens for each parameter cycle continuously and indicate, respectively, the value, date and time of each parameter. The "E" located on the right top line indicates that by pressing ENTER while viewing any of the three pertinent screens, the values retained in drag-hand memory will be reset to the present value.

The unit is equipped with a real-time clock to allow a date/time stamp to be recorded in conjunction with each drag-hand quantity.

Status Screens (cont.)

FIG 9-6

BIAS VOLTAGE FUNCTION

When ENTER is pressed from the Bias Voltage Test Mode screen, the bias test voltage can be entered to test the control's automatic operation. The figure below shows the status conditions indicated by this screen.

```
BIAS VOLTAGE 0.0
R 119.3 HI BR BK
```

Output Status
Indicates any one of the following:
R = Raise output is active
L = Lower output is active
*blank* = control within band

Local Voltage
Indicates real-time measured value of voltage at the regulator or transformer

Band Status
Indicates any one of the following:
HI = voltage is out of band high
LO = voltage is out of band low
*blank* = In-band

Run Back / Blocking Status
Indicates any one of the following:
FR = Force Raise
FL = Force Lower
BR = Block Raise
BL = Block Lower
LL = Block Line Limit
*blank* = OK

Voltage Reduction / Blocking Status
Indicates any one of the following:
R1 = Voltage Reduction Step #1 in effect
R2 = Voltage Reduction Step #2 in effect
R3 = Voltage Reduction Step #3 in effect
BK = Blocked by non-sequential input or reverse power (with reverse power blocking enabled) or by communication command.
*blank* = OK

Bias Test Voltage
Adjustable from –6.0 V to +6.0 V in 0.1 V increments.
Factory setting is 0.0.

Bias Test Voltage Screen

FIG 9-7

Software Flow–Setpoint Menu

Software Flow–Setpoint Menu (cont.)

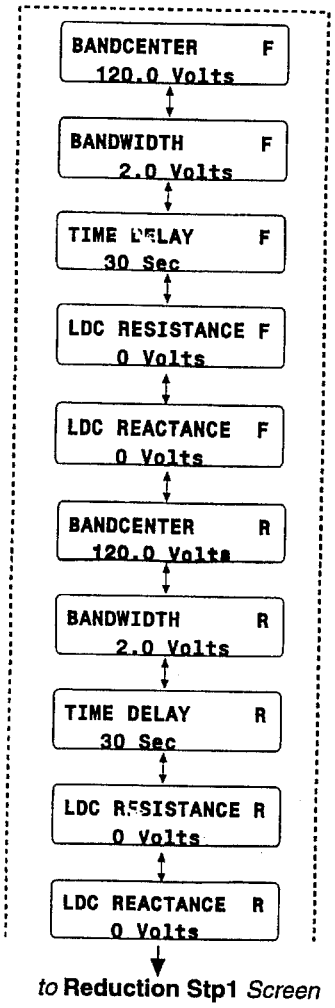

Forward power bandcenter is adjustable from 100 V to 135 V in 0.1 V increments with a factory setting of 120 V.

Forward power bandwidth is adjustable from 1 V to 6 V in 0.1 V increments with a factory setting of 2.0 V.

Forward power time delay for a tapchange is adjustable from 5 sec. to 120 sec. in 1 second increments with a factory setting of 30 sec.

Forward power Line Drop Compensation resistance is adjustable from -24 V to +24 V in 1 V increments with a factory setting of 0 V.

Forward power Line Drop Compensation reactance is adjustable from -24 V to +24 V in 1 V increments with a factory setting of 0 V.

Reverse power bandcenter is adjustable from 100 V to 135 V in 0.1 V increments with a factory setting of 120 V.

Reverse power bandwidth is adjustable from 1 V to 6 V in 0.1 V increments with a factory setting of 2.0 V.

Reverse power time delay for a tapchange is adjustable from 5 sec. to 120 sec. in 1 second increments with a factory setting of 30 sec.

Reverse power Line Drop Compensation resistance is adjustable from -24 V to +24 V in 1 V increments with a factory setting of 0 V.

Reverse power Line Drop Compensation reactance is adjustable from -24 V to +24 V in 1 V increments with a factory setting of 0 V.

Setpoint Screens

FIG 9-10

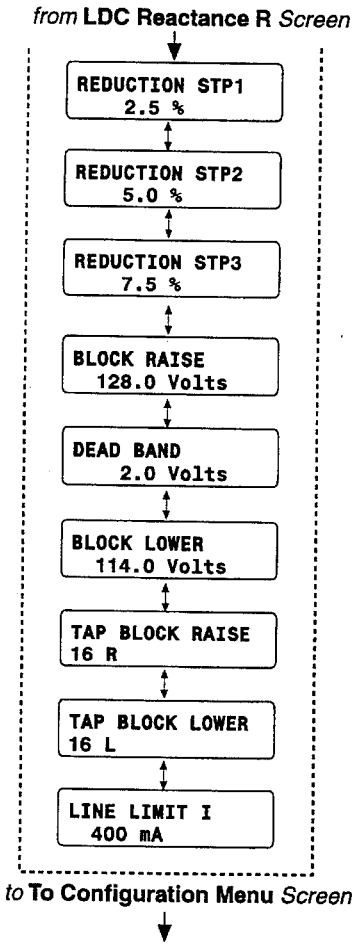

First of three independent steps of voltage reduction adjustable from 0% to 10% in 0.1% inacrements of the bandcenter setpoint. Factory setting is 2.5%.

Second voltage reduction step. Factory setting is 5.0%.

Third voltage reduction step. Factory setting is 7.5%.

Over voltage limit is adjustable from 95 V to 135 V in 0.1V increments with a factory setting of 128 V. The Block Raise setpoint should always be set above the Block Lower setpoint *and* above the upper band limit (the bandcenter plus one-half of the bandwidth) for the control to operate.

Deadband is adjustable from 1V to 4 V in 0.1 V increments with a factory setting of 2.0 V.

Under voltage limit is adjustable from 95V to 135V in 0.1V increments with a factory setting of 114 V. The Block Lower setpoint should always be set below the Block Raise setpoint *and* below the lower band limit (the bandcenter plus one-half of the bandwidth) for the control to operate.

Adjustable from 8 to 16 Raise in 1 step increments with a factory setting of 16 Raise.

Adjustable from 8 to 16 Lower in 1 step increments with a factory setting of 16 Lower.

Line limit is adjustable from 200 mA to 640 mA in 1 mA increments with a factory setting of 400mA with hysteresis of 5 mA. If the value of the current exceeds the line limit setpoint, the unit will not permit automatic control, in either the raise or lower direction.

Setpoint Screens (cont.)

FIG 9-11

Software Flow–Configuration Menu

Software Flow–Configuration Menu (cont.)

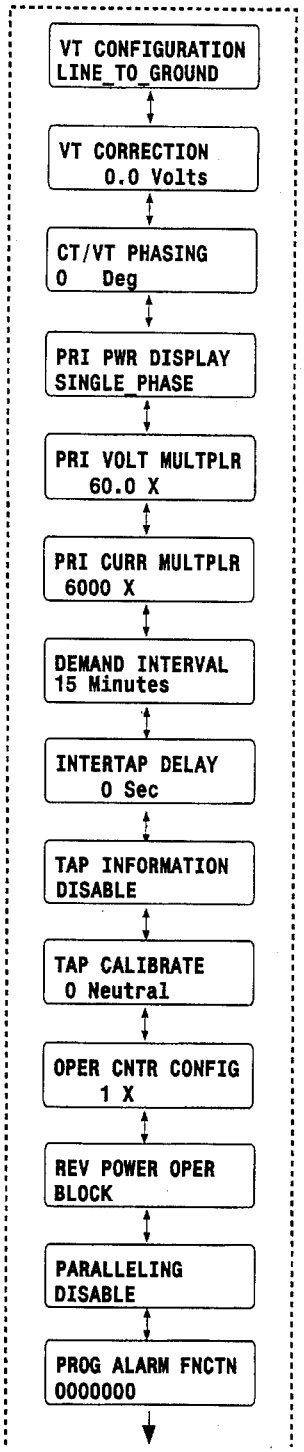

*to* Level 1 Password *Screen*

VT configuration toggles between Line-to-Line and Line-to-Ground with a factory setting of Line-to-Ground.

VT ratio correction is adjustable from -10V to +10V in 0.1V increments with a factory setting of 0 V.

CT/VT phasing correction is adjustable from 0° to 330° in 30° increments with a factory setting of 0°.

Toggles between two modes of operation: Single-Phase-based on measured inputs, and Three-Phase-based on measured inputs and presumed balanced system. Factory setting is single-phase.

Adjustable from 0.1 to 3260 in 0.1 increments with a factory setting of 60. User selection to include knowledge of VT ratio,sensing VT ratio correction and indication of either line-to-line or line-to-ground voltage.

Adjustable from 1 to 32600 in 1.0 increments with a factory setting of 6000. User selection to include knowledge of CT ratio.

Toggles between 15,30 and 60 minute intervals with a factory setting of 15 minutes. The time intervals is that amount of time it takes for a thermal meter to indicate 90% of a change of load.

Adjustable from 0 to 10 Seconds in 1.0 second increments with a factory setting of 0 seconds.

Toggles between two modes of operation: Internal–to use "keep track" tap position knowledge and Disable–to disable all tap position-related functions. Factory setting is Disable.

Allows input of known tap position to calibrate the unit tap position. Recognizes tap positions 1 to 16 Raise, Neutral, and 1 to 16 Lower.

Toggles between one and two counts per open-close-open operation of LTC counter switch with a factory setting of one count.

Toggles between two modes of operation: Ignore-to continue unit action as though Forward Power Flow continued to exist, and Block-to inhibit automatic tapchange operation.

Toggles between two modes of operation: Circulating Current-to select this method of paralleling and Disable. Factory setting is Disable.

Provides alarm for one or more of the following user-selected conditions: Block Raise Limit exceeded, Block Lower Limit exceeded, Voltage Reduction (any step) invoked, Reverse Power Flow condition detected, LIne Limit Current exceeded, Tap Block Raise in effect, and Tap Block Lower in effect. The Disable condition is the factory setting. (Bottom line of display indicates seven zeroes.) See Figure A-8 for more information.

Configuration Screens

FIG 9-14

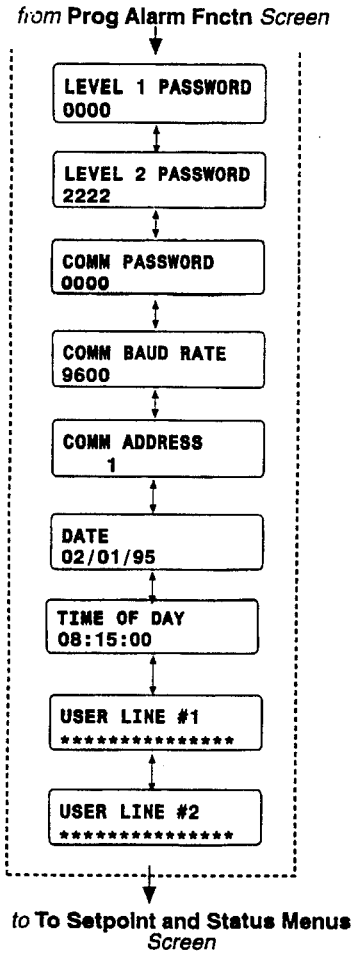

Configures a four-digit numerical password for Level 1. Factory setting is 0000 (disabled).

Configures a four-digit numerical password for Level 2. Factory setting is 2222.

Configures a four-digit numerical password for remote communications. Factory setting is 0000 (disabled).

Configures baud rate for remote communications by selection of 300, 600, 1200, 2400, 4800, or 9600. Factory setting is 9600 baud rate.

Configures a three-digit numerical address, from 1 to 200, for remote communications. The factory setting is 1.

Allows setting of date. Used in conjunction with drag-hand memories where thate/time stamp will be recorded for each drag-hand quantity.

Allows setting of real-time 24-hour clock. Used in conjunction with drag-hand memories where the date/time stamp will be recorded for each drag-hand quantity.

Allows input of 15 ASCII characters to configure a unit locator or description. If not configured, a row of 15 asterisks will appear in top row of User Line #1 screen.

Allows input of 15 ASCII characters to configure a unit locator or description. If not configured, a row of 15 asterisks will appear in bottom row of User Line #2 screen.

Configuration Screens (cont.)

FIG 9-15

PROGRAMMABLE ALARM FUNCTION

The programmable alarm function can provide an alarm for one or more of seven conditions. Each condition corresponds to one of seven digits on the bottom line of the display: a "0" indicates that the alarm condition is disabled; a "1" indicates that the alarm condition is enabled. The figures below show how to program this function.

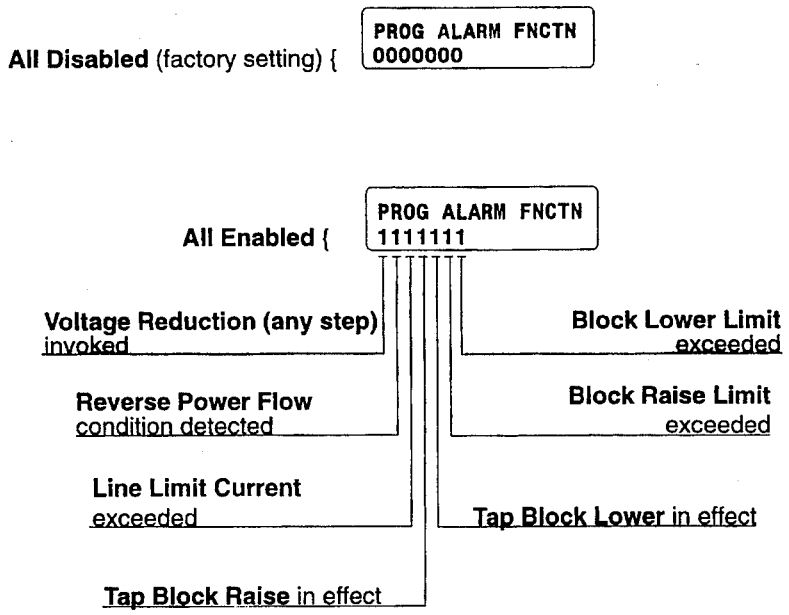

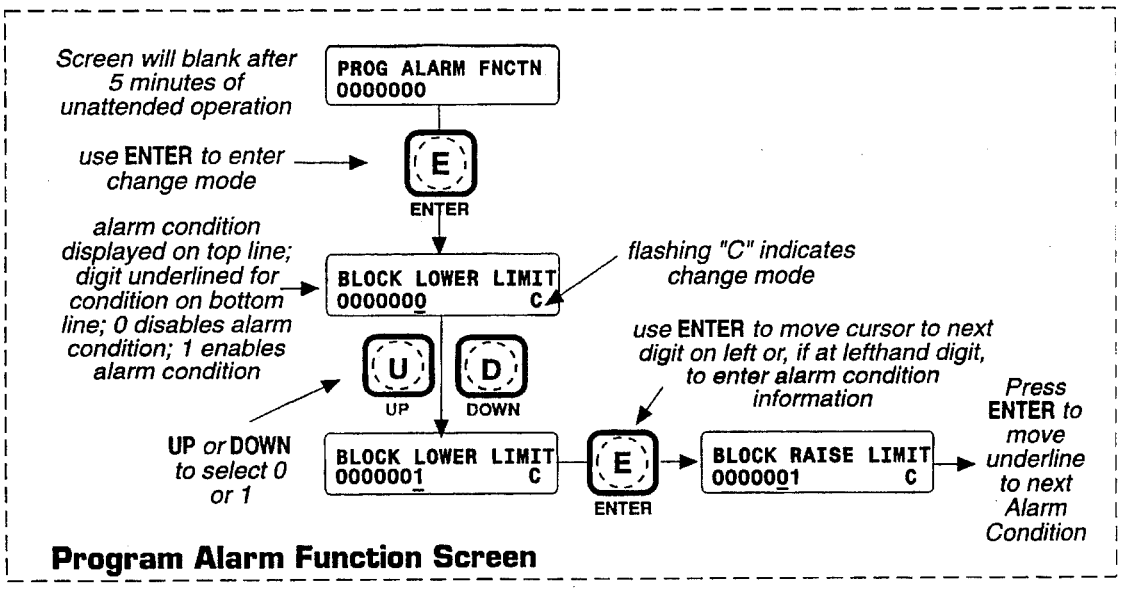

Programmable Alarm Function Screen

FIG 9-16

MICROCONTROLLER-BASED TAP CHANGER CONTROLLER EMPLOYING HALF-WAVE DIGITIZATION OF A.C. SIGNALS

CROSS-REFERENCE TO RELATED APPLICATIONS

This application is a continuation-in-part application of U.S. patent application Ser. No. 07/816,242, filed Dec. 31, 1991, now U.S. Pat. No. 5,315,527, and is a continuation-in-part application of U.S. patent application Ser. No. 08/080,822, filed Jun. 24, 1993, now abandoned.

BACKGROUND OF THE INVENTION

1. Field of the Invention

This invention relates to tap-changers for voltage regulators and load tap-changing transformers. More particularly, this invention relates to microcontroller-based tap-changer controllers employing half-wave digitization of A.C. signals.

2. Description of the Background Art

In electrical power distribution systems, voltage levels tend to vary due to several factors such as load, line inductance, or line resistance. In order to maintain the voltage level within a predefined range or bandwidth of a fixed voltage level (e.g., 120 volts), load tap-changing (LTC) transformers or series regulating auto transformers using tap-changer switching are employed to incrementally increase or decrease the line voltage.

Typically, tapped auto transformers comprise a tapped series winding that facilitates plus or minus ten percent regulation, a shunt winding across the regulator input terminals, a voltage transformer which measures the output voltage, and a current transformer which measures the load current at the output terminal. A two-position switch is provided which can be placed in a raise or lower position, depending upon whether the regulator is used to "boost" (increase) or "buck" (decrease) the load voltage. The reversing switch is connected across the ends of the series winding. Under this arrangement with the reversing switch in the raise position, the series winding becomes additive with respect to the shunt winding as the number of turns placed in series with the load increases. Therefore, the amount of voltage boost increases. When the reversing switch is moved to the lower position, the series winding, therefore, becomes subtractive with respect to the shunt winding and the amount of the buck depends upon the number of turns placed in series with the line.

The typical load tap-changing transformer and tap-changer switch provide approximately plus or minus ten percent voltage regulation by selecting the proper tap on the transformer secondary. The taps are usually part of a fixed secondary winding and select voltages that are plus or minus a fixed percentage from a nominal voltage.

Presently, there exists many types of automatic tap-changer controls for changing the tap settings of the load tap-changing transformers and regulators. Historically, tap-changers employed analog controllers such as those illustrated in U.S. Pat. Nos. 2,280,766, 2,009,383, and 2,381,271. The more dominant analog tap-changer controls are sold under the registered trademarks "Siemens (Allis)" Models MJ-1A, MJ-2A, MJ-3, MJ-3A, IJ-2, IJ-2A, SJ-4, SJ-5, SJ-6, UA and UJ, "General Electric" Model ML-32, VR-1, SM-2A, "Cooper" Model CL-2, CL-2A, CL-4A, CL-4B and CL-4C and "Beckwith" Models M-0067 and M-0270 series.

More recently, microprocessor-based tap-changer controllers have been developed such as the one disclosed in U.S. Pat. No. 4,419,619 issued to McGraw-Edison Company (now Cooper Power Systems). In this McGraw-Edison tap-changer controller, the microcomputer is interfaced to the regulator by means of interface circuits that provide digital data of sampled voltage and current signals to the microcomputer. Software employed within the microcomputer performs Fast Fourier Transforms (FFT) on the sampled voltage and current signals. The McGraw-Edison tap-changer controller uses an external data acquisition system which includes a bi-polar analog to digital (A/D) converter with the associated circuitry of a multiplexer, a sample and hold circuit and a bi-polar voltage reference. In addition to the external data acquisition system, external circuits also include programmable timers, serial communications interfaces, reprogrammable non-volatile memory and peripheral interface adapters. This McGraw-Edison controller has a second voltage input which measures the voltage on the "difference" winding across the source to load of the regulator that supplied voltage difference information to the control. Using this information, the controller calculates the tap-changer position, as it knows the voltage differential per tap of the regulator. Also, the difference voltage is used to calculate the source voltage for regulation during reverse power operation. However, this method requires an additional analog voltage input signal and would only be applicable to regulators equipped with a voltage differential winding.

A microcomputer-based tap-changer controller provides many advantages over analog tap-changer controllers, such as accuracy, flexibility, ease of use and adaptability. Microcomputer-based tap-changer controllers may be connected to a central computer via a serial communications port to achieve more automated power distribution.

There presently exists a need for a microcontroller-based tap-changer controller that employs an accurate yet simpler data acquisition system and simplified external hardware to the microcontroller along with methods for calculating the source side voltage for reverse power operation without the need for a second voltage input.

Therefore, it is an objective of this invention to provide an improvement which overcomes the aforementioned inadequacies of the prior art controllers and provides an improvement which is a significant contribution to the advancement of the tap-changer controller art.

Another objective of this invention is to provide a microcontroller-based tap-changer controller that accurately controls a conventional tap-changer and yet comprises a simpler and less expensive design than is presently available in microcontroller-based tap-changer controllers.

A further objective of this invention is to provide a single control that can be used interchangeably with a variety of regulators and LTC transformers.

The foregoing has outlined some of the pertinent objectives of the invention. These objectives should be construed to be merely illustrative of some of the more prominent features and applications of the intended invention. Many other beneficial results can be attained by applying the disclosed invention in a different manner or modifying the invention within the scope of the disclosure. Accordingly, other objectives and a fuller understanding of the invention are set forth in the detailed description of the preferred embodiment in addition to the scope of the invention as defined by the claims and taken in conjunction with the accompanying drawings.

SUMMARY OF THE INVENTION

For the purpose of summarizing this invention, this invention comprises an improved microcontroller-based tap-changer controller having the following features.

First, a microcontroller was chosen that contains, on a single chip, the data acquisition system including an 8-channel multiplexer, an 8-bit A/D converter designed for unipolar operation and electrically erasable programmable memory for storing setpoints.

Another feature of the present invention is the simplification resulting from using half-cycle digitization of the AC signals being sampled that eliminates the need for a bi-polar A/D converter and its attendant bi-polar power supply. This feature also allows all of the available resolution of the A/D converter to be applied to one half of the waveform permitting a greater degree of resolution.

Still another feature of the present invention is the significant reduction of the size of the controller to permit an interchangeable modular configuration thereby allowing all the interface, processing, communications, automatic switching and memory functions along with a man-machine interface to be included in the interchangeable module. The module interfaces to a variety of adaptor panels through a standardized connector. The adaptor panels provide the necessary mechanical and manual electrical interface to replace a variety of original equipment manufacturers' (OEM) tap-changer controllers, both for regulators and LTC transformers.

An additional feature of the present invention is the improvement to the tap-changer controller's noise immunity and susceptibility. In addition to the conventional use of Metal Oxide Varistors (MOVs) and small radio-frequency bypass capacitors to ground, the invention utilizes ground plane technology throughout the construction of the printed circuit board to reduce ground path radio frequency (R.F.) impedances. All input and output power circuits are referenced to line neutral whereas the microcontroller and associated circuitry is referenced to chassis ground. Isolation is provided for the physical and electrical isolation of all microcontroller circuitry by means of relays, transformers or opto-electric isolators.

Another feature of the present invention is the significant reduction in the complexity of the user interface. First, a 2-line by 16-character full alphanumeric vacuum fluorescent display is used to provide sufficient prompting to the user who may have limited familiarity with the controller to operate it without referring to instruction literature. By choosing a vacuum fluorescent display, the user interface operates over a wide temperature range without heaters to be placed in near proximity of the display and does not require ambient light for readability as the display is light producing.

Secondly, instead of a multiplicity of push buttons or a key pad for entering digital data, a three push-button interface is used. Working in conjunction with the informative display, two of the push buttons are dedicated to "up" and "down" functions and are therefore labelled "up" and "down". The "up" and "down" buttons allow the operator to scroll the menus up and down, screen by screen, until the desired menu is located. A third button, labelled "enter", is then used to enter the selected menu for change. The "up" and "down" buttons are then used to raise or lower a preselected default value shown or scroll through options for the selected screen. When the desired numerical value is reached or the desired option is shown, the "enter" button is once again pressed to store the option or value in the non-volatile memory for that selected menu screen.

Another feature of the present invention is the use of a generalized "keep-track" tap-position knowledge function. In contrast to the McGraw-Edison patent that required a "difference" winding across the source to load of the regulator, in the present invention, a menu screen allows a tap-position value to be entered by the user that corresponds to the current tap position and the tap position can be updated using a "keep-track" method. Not only can output devices of the controller supply power to the tap-changer motor windings, but also to any number of external contacts. Such external contacts include manual switching by the operator and external contacts from various control circuits (including Supervisory Control and Data Acquisition System (SCADA)) external to the control itself. The commonalty is that all such switches and relay contacts are essentially paralleled across the output devices of the tap-changer controller, since they are powered from the same source. This being the case, an open switch or contact has essentially infinite resistance and as such has the entire voltage dropped across its contacts. By implementing a circuit which detects the absence of voltage, it is reliably determined whether a raise or lower tap-change condition exists and coupled with a counter input to the controller, a tap-change operation in the proper direction is registered and the new tap position is determined. Also, to improve the reliability of the keep-track method of tap position indication, the neutral position contact is used to reset the keep-track tap position to neutral whenever the tap-changer is passing through the neutral position.

Another feature of the present invention is the use of the "keep-track" tap position to calculate the source voltage of the regulator for reverse power operations without employing a source side voltage transformer thereby reducing the cost of regulator installation for reverse power operations.

Since the controller has knowledge of the tap position, limits can be set by specifying the highest and lowest tap excursions. Operation beyond those limits is blocked. This is an improvement over prior art where mechanical stops are installed to limit tap excursion. The limits can be set by the user either through the button interface or by the communications port.

The test voltage screen allows the operator to set a bias voltage which will modify the measured local voltage thereby causing the tap-changer control to operate (raise or lower). This will provide an easy method of testing from the front panel without additional test equipment.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objectives of the invention, reference should be made to the following detailed description taken in connection with the accompanying drawings in which:

FIGS. 6A and 6B are schematic diagrams of the interface board illustrating the isolation between the components of the tap-changer controller of the invention;

FIGS. 9-1 through 9-16 illustrate the menus and screens of the computer software including the status menu, status screens, bias test voltage screen, setpoint menu, setpoint screens, configuration menu, configuration screens, programmable alarm function screen; and FIG. 10 is a schematic diagram of the current loop circuit of the invention designed to interface the current loop of a tap position transducer to the analog voltage tap position input of the controller.

Similar reference characters refer to similar parts throughout the several views of the drawings.

DETAILED DESCRIPTION OF THE PREFERRED EMBODIMENT

Figure 1:
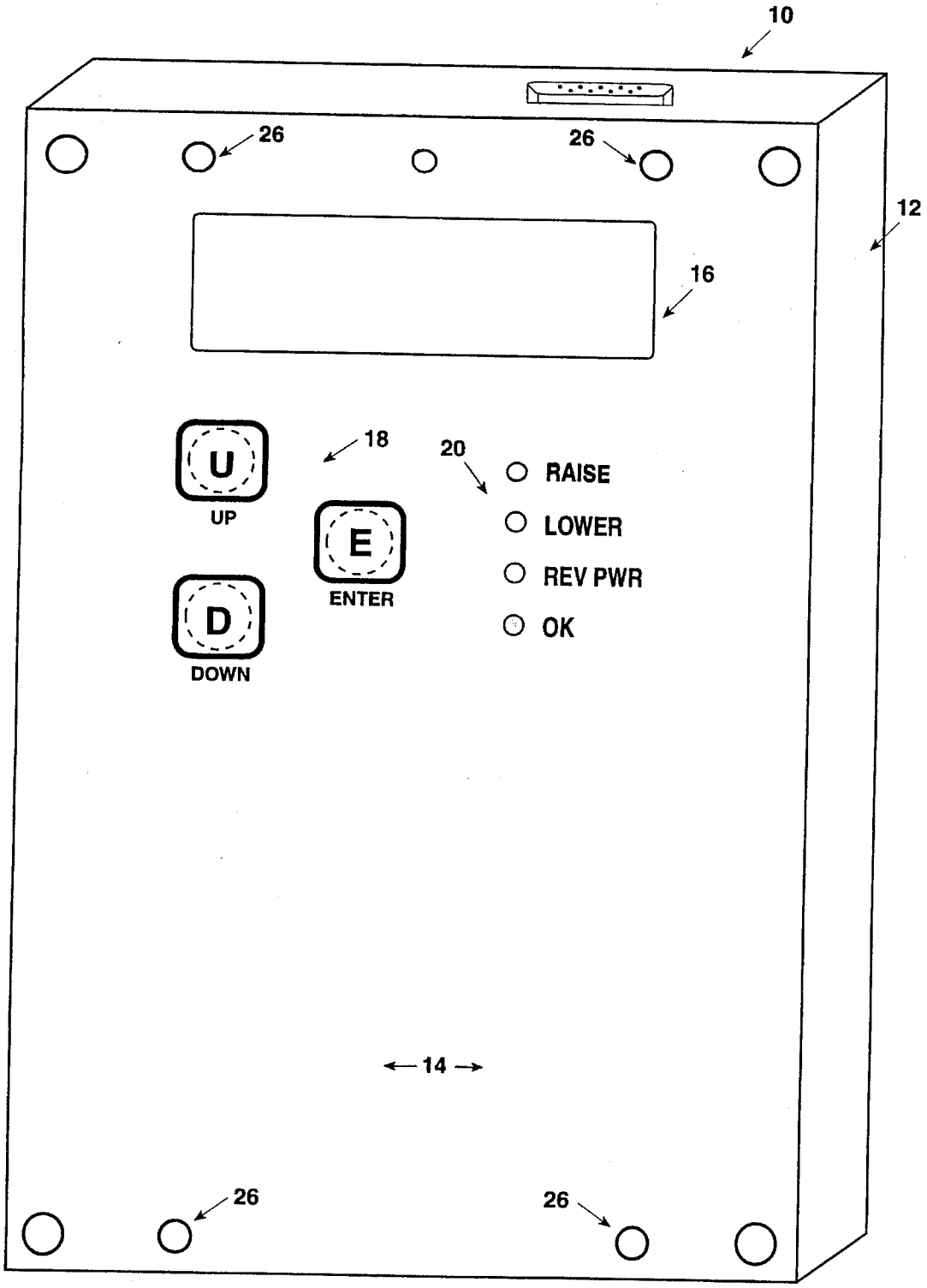
FIG. 1 is a perspective view of the microcontroller-based tap-changer controller of the invention.

As shown in FIG. 1, the microcontroller-based tap-changer controller 10 of the invention is contained within a generally rectangular housing 12. The front panel 14 of the housing includes a two-line by 16 character alphanumeric vacuum fluorescent display 16 and "up", "down" and "enter" buttons 18 for interface with the operator through a series of scrollable menus. Light-emitting diodes (LED) 20 are provided for indicating a "raise", "lower", "reverse power" and "ok" status conditions to the operator.

Figure 2A:
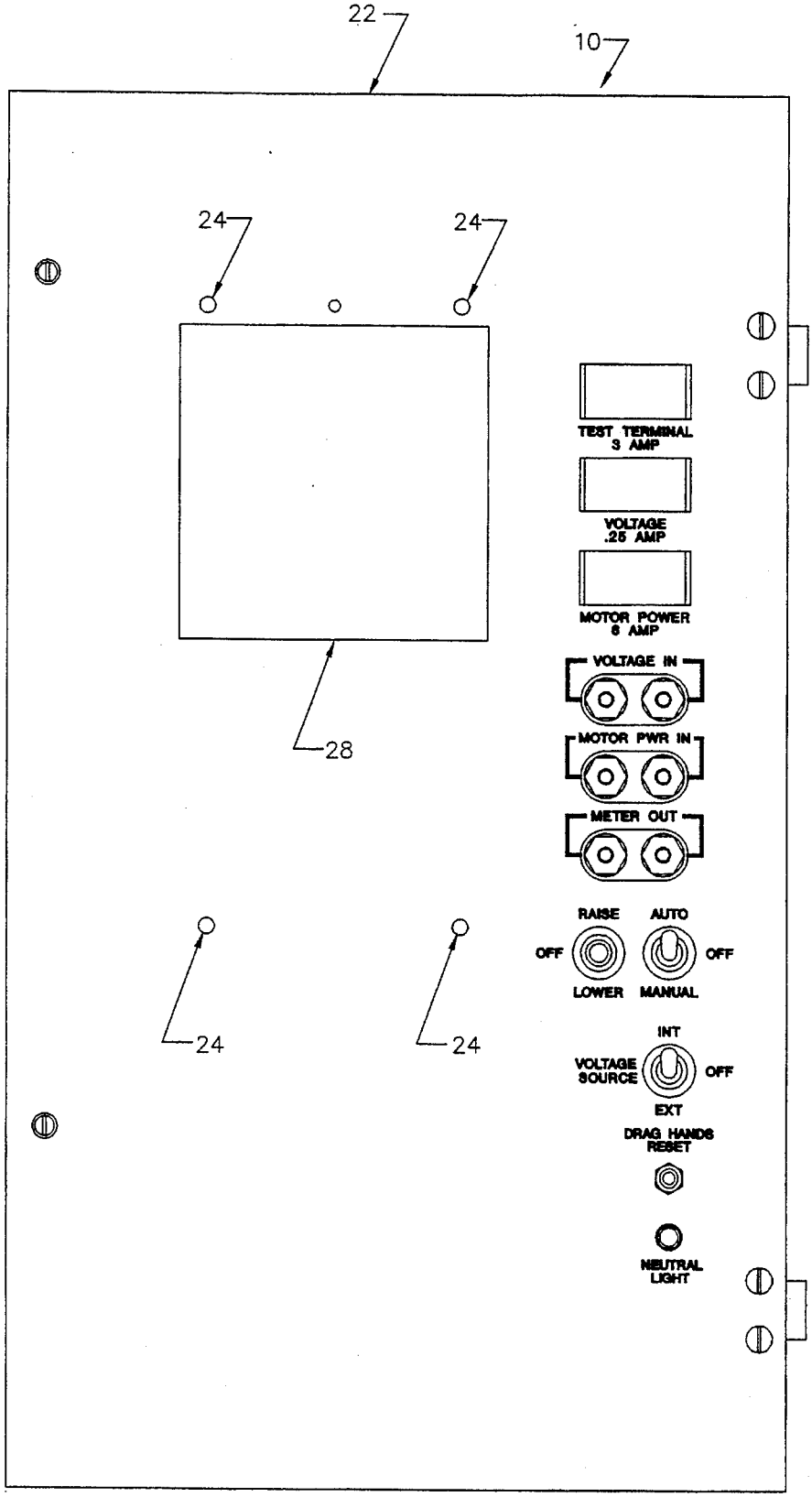
FIGS. 2A and 2B are front and rear plan views of one particular style of an adaptor panel of the invention that permits the tap-changer controller of the invention to be installed in an existing tap-changer controller housing without structural changes to such housing.
Figure 2B:
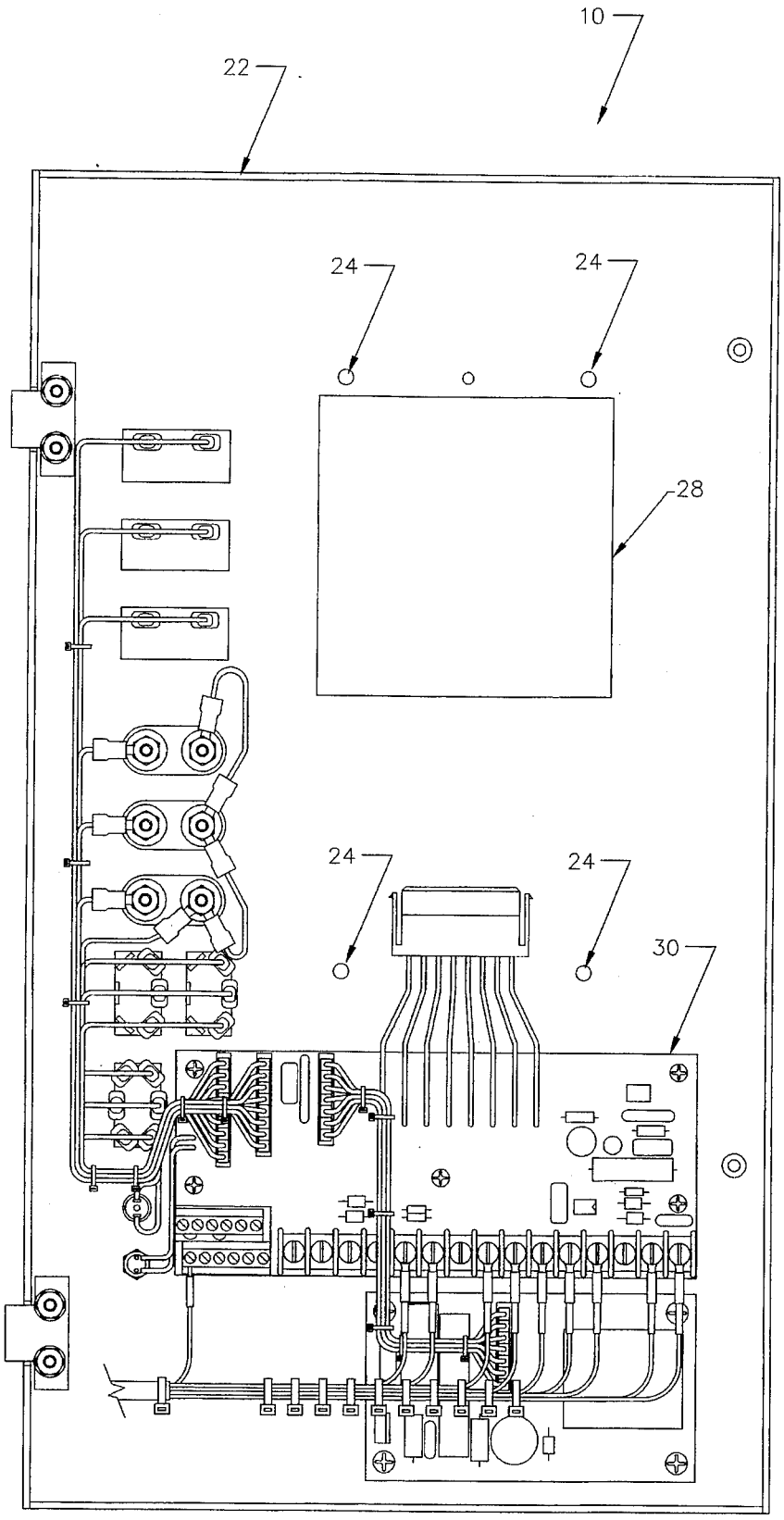
Figure 3A:
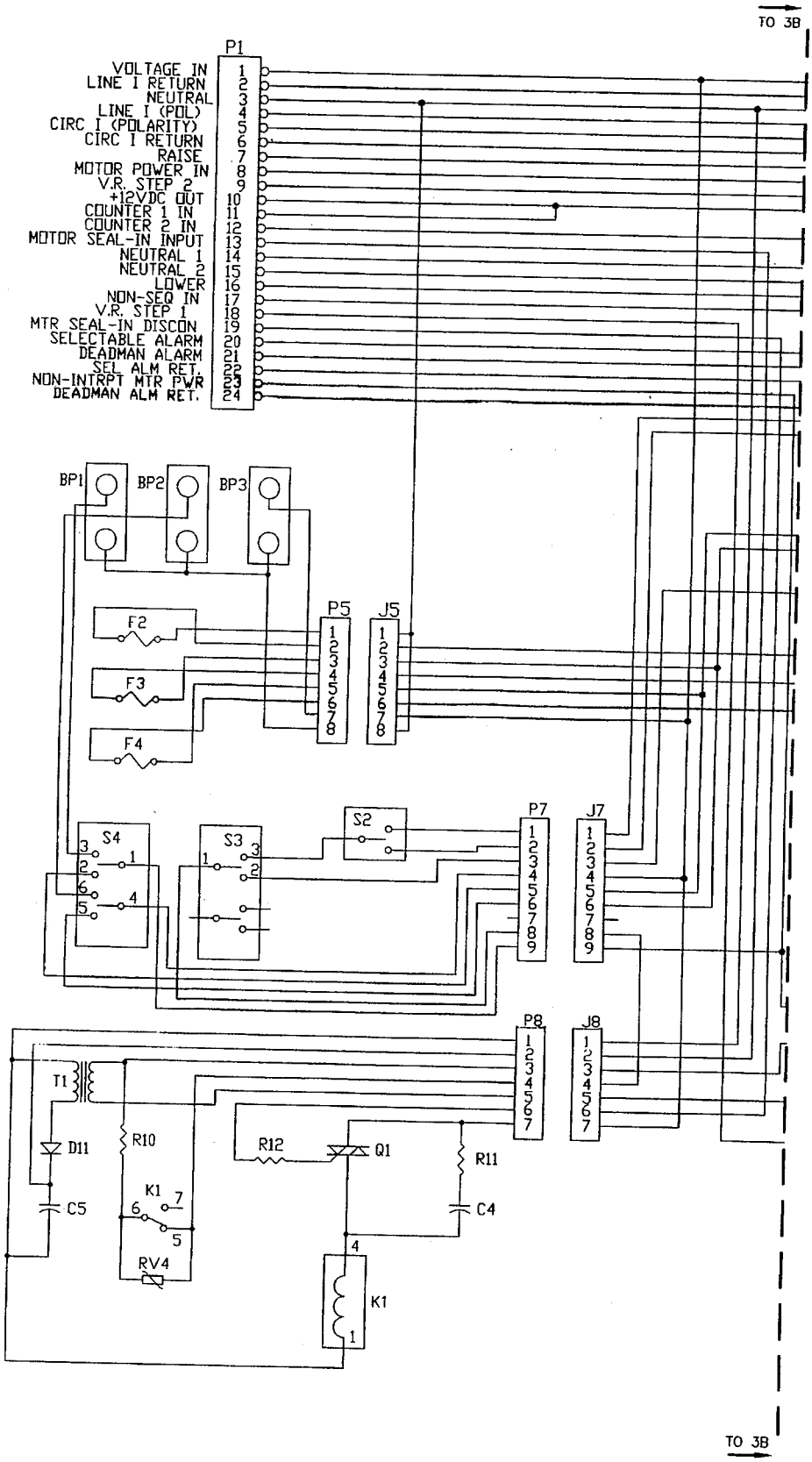
FIG. 3 is a wiring diagram of the components of the adaptor panel to the tap-changer controller.
Figure 3B:
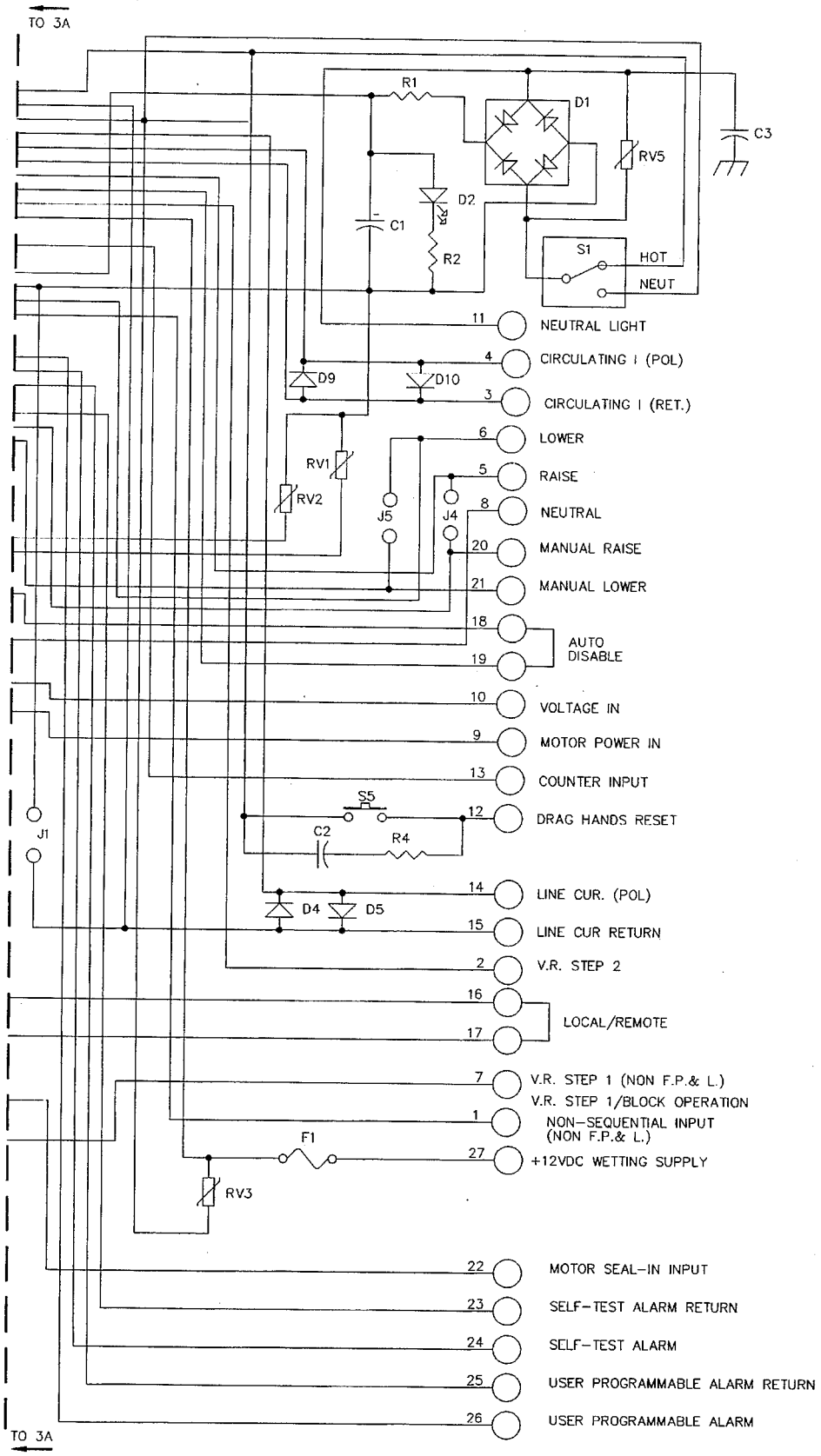

The invention further comprises a variety of adaptor panels 22 for the replacement of the more dominant analog tap-changer controllers such as those noted above in the Description of the Background Art. FIGS. 2A and 2B are front and rear views of an adaptor panel 22 of the invention that is configured and dimensioned to replace the front panel of a Cooper (formerly known as McGraw-Edison) tap-changer controller. The tap-changer controller of the invention is easily mounted to this specific adaptor panel (or to any other respective adaptor panels for other OEM tap-changers) by means of screws (not shown) inserted through the holes 24 in the adaptor panel 22 to threadably engage threaded holes 26 in the controller 10. Opening 28 provides user access to the display 16, buttons 19 and LEDs 20.

A PCB 30 with appropriate circuitry is mounted to the backside of the adaptor panel 22. As shown in the wiring diagram of FIG. 3, the adaptor panel circuitry is designed to facilitate connection to a variety of tap-changers that are presently in service. The adaptor panel for the Cooper tap-changer was selected for illustrating the broad adaptability of the controller of the invention since, unlike most other OEM tap-changers, a Cooper tap-changer provides motor seal-in contacts.

More particularly, the wiring circuit of the invention includes a seal-in circuit (on a separate PCB) having a relay K1 with contacts that are effectively connected in series with the motor power. During a tap change operation, the current flow through the motor seal-in contacts (not shown as they are external to the contoller) is sensed by transformer T1, and under software control, relay K1 is actuated by firing triac Q1 so that the motor power is removed. The operations counter is then incremented and the direction of tap change is obtained through the keep-track circuitry which is detailed hereinafter.

Consequently, it should be appreciated that the controller of the invention may operate with this motor seal-in circuit for Cooper tap-changers or without it for the other OEM tap-changers by simply not utilizing the motor seal-in circuit connected at connector P8/J8.

Importantly, it is noted that during initial installation, the harness assembly from the tap-changer is easily connected to the wiring block of the PCB of the adaptor panel. It is also noted that harness assembly from the components on the adaptor panel is easily connected to the controller by connector P2/J2. Consequently, as should be appreciated, this modularity greatly increases the ease in which the microcontroller-based tap-changer controller of the present invention can be substituted for conventional analog (and microcontroller-based) controllers. Furthermore, should the controller become defective, it can be easily substituted in the field with a replacement via the connector P2.

Figure 4:
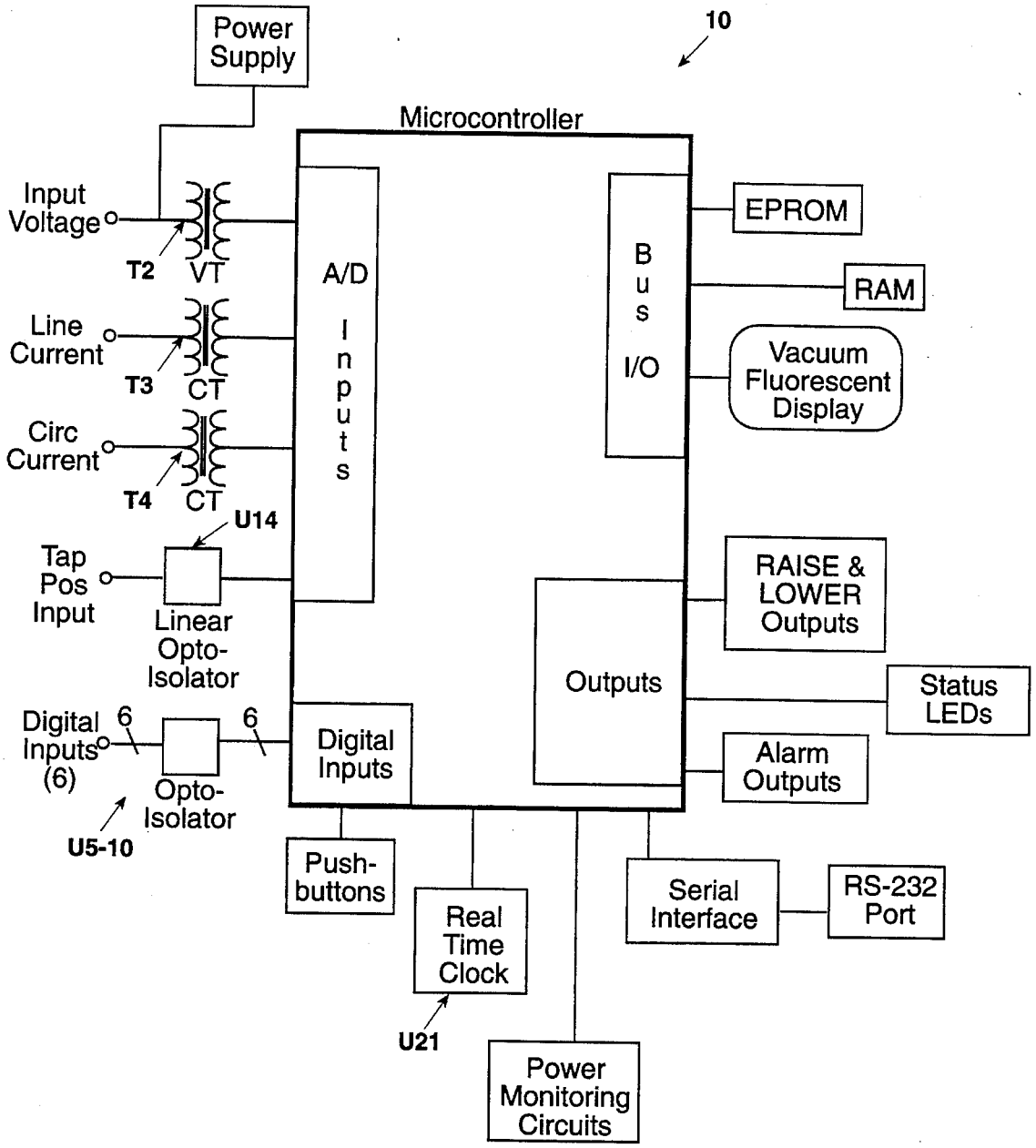
FIG. 4 is a block diagram of the microcontroller-based tap-changer controller of the invention illustrating the various components and interfaces thereof.

The microcontroller-based tap-changer controller of the invention preferably utilizes a computer-on-a-chip such as the Motorola MC68HC11 microcontroller. See generally, the reference manual *Motorola HC*11 *Reference Manual M68HC*11*RM/AD REV* 1, which is hereby incorporated by reference herein. FIG. 4 is a block diagram of the controller of the invention that employs this type of microcontroller. More particularly, a microcontroller of this type simplifies the circuit design and reduces the circuit complexity by incorporating a number of functions that previously required external peripheral circuitry. These include analog signal multiplexing, analog to digital converters, programmable timers, serial communications interface, reprogrammable non-volatile memory and peripheral interface adapters, which are now on-board the microcontroller.

The analog inputs to the microcontroller are line voltage, line current, circulating current when used in paralleling of multiple transformers, and an input for the tap position transducer. These signals are conditioned and fed to the internal A/D convertor section of the microcontroller.

The digital inputs to the microcontroller are mostly used for status input and are fed to an 8-bit latch on the data bus using proper noise suppression techniques and optical isolation with built-in noise suppressing hysteresis characteristics.

A real-time clock is provided external to the microcontroller to provide date and time stamping capability for the controller. Power monitoring circuits are also included external to the microcontroller to dectect power fail conditions thereby storing operations count and tap-position keep track during power interruptions. An external RS-232 serial driver provides proper serial signal drive levels.

The microcontroller includes raise and lower solid state motor power switching outputs capable of handling 120 or 240 VAC at up to 6 Amperes RMS. Further, two single pole relay alarm contacts (one normally open and the other normally closed) are provided and are capable of handling up to 1 Ampere at 120 VDC station battery power.

The 16-bit address bus and the 8-bit data bus of the microcontroller are used to interface 8K bytes of static RAM and 56K bytes of EPROM program memory external to the microcontroller. A 2-line by 16-character alphanumeric vacuum fluorescent display and a 3-push button man-machine interface provide complete front panel operator access to the scrolling menu program structure of the controller.

Finally, a linear regulated +5 volt power supply supplies power for the circuitry and display, with a precision +5 volt reference used for A/D conversion reference.

Figure 5:
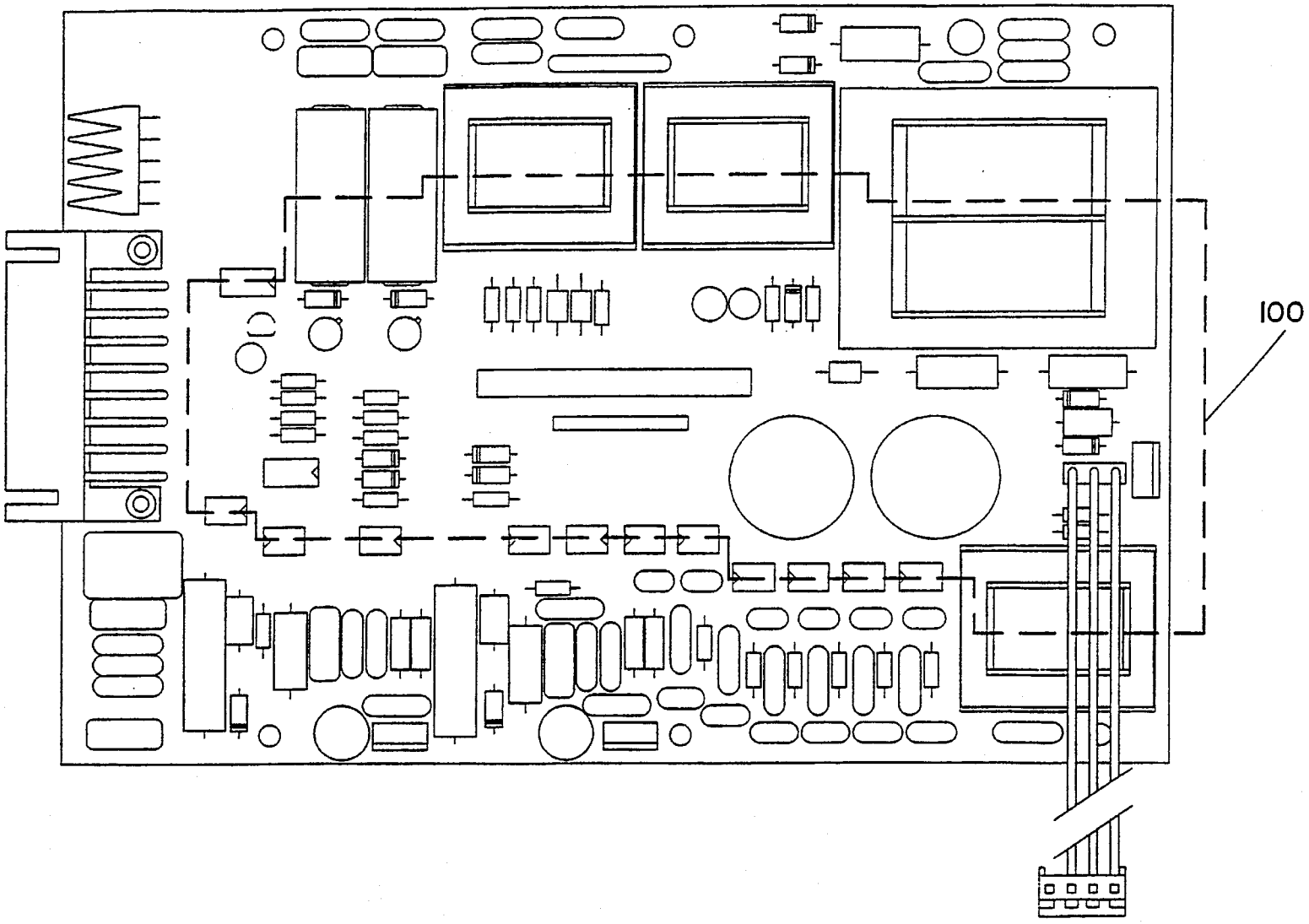
FIG. 5 is a top plan view of the interface printed circuit board (PCB) illustrating the electrical isolation of the components referenced to line neutral from the components referenced to chassis ground by means of opto-isolators, relays and isolation transformers.

The microcontroller-based tap changer controller of the invention incorporates ground plane and surge suppression technology for protection of the digital and analog hardware. Preferably, as shown in FIG. 5, the opto-isolators and isolation transformers are mounted on a single printed circuit board (PCB) about the periphery thereof with the center portion of the PCB containing some of the interface components and a connector P4/J4 for connection to the microcontroller that is mounted on a separate PCB (see 100). In this manner, all of the circuitry outside of the dotted line as shown in FIG. 5, is referenced to line neutral whereas all of the circuitry inside the dotted line (including the microcontroller connected via connector P4/J4) is referenced to chassis ground. Experiments have demonstrated that this particular arrangement provides isolation that meets or exceeds published standards, such as the *IEEE Standard Surge Withstand Capability (SWC) Tests for Protective Relays and Relay Systems* (IEEE C37.90.1-1989). Accordingly, this particular arrangement is considered to be an inventive aspect of the present invention.

Figure 6A:
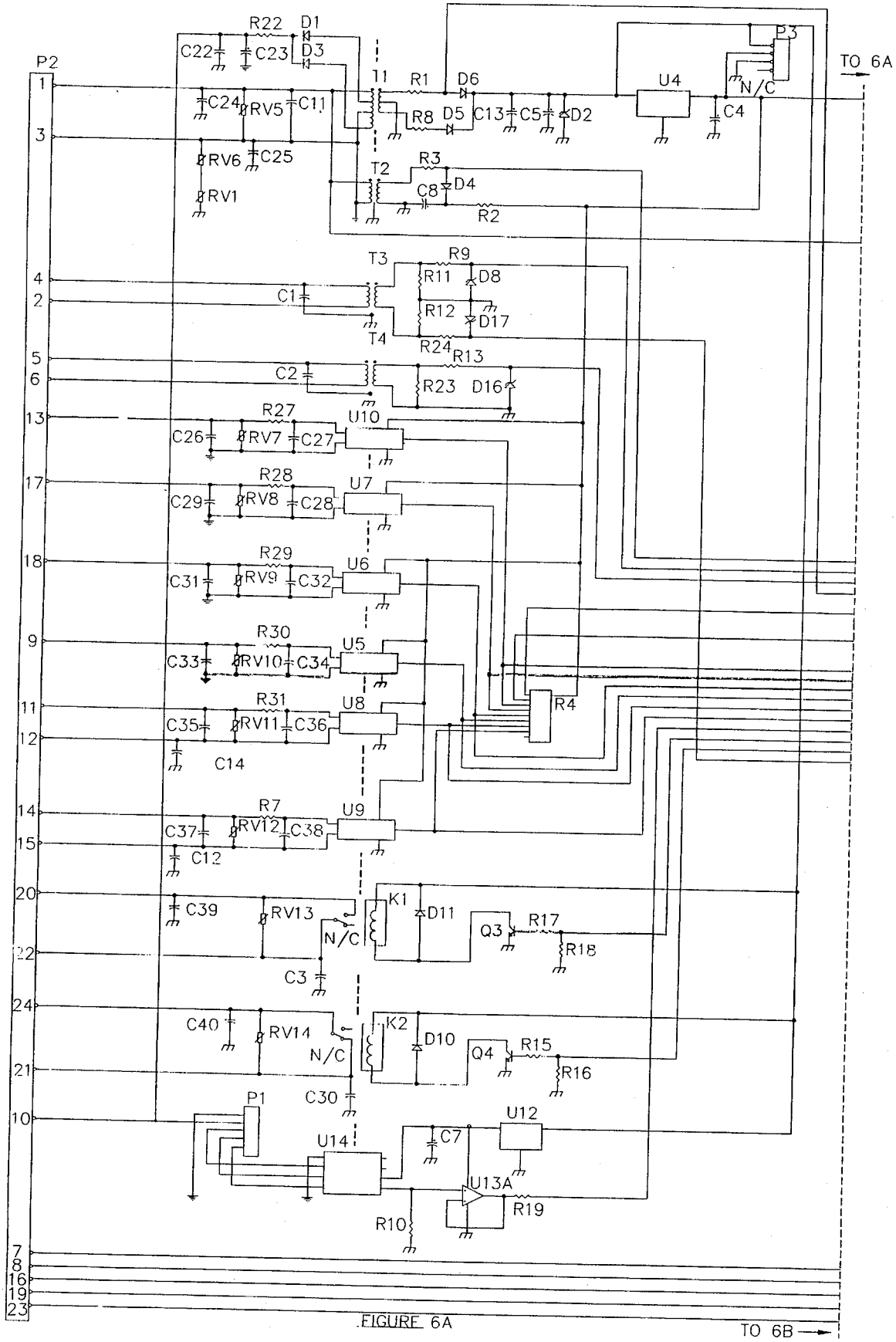
Figure 7A:
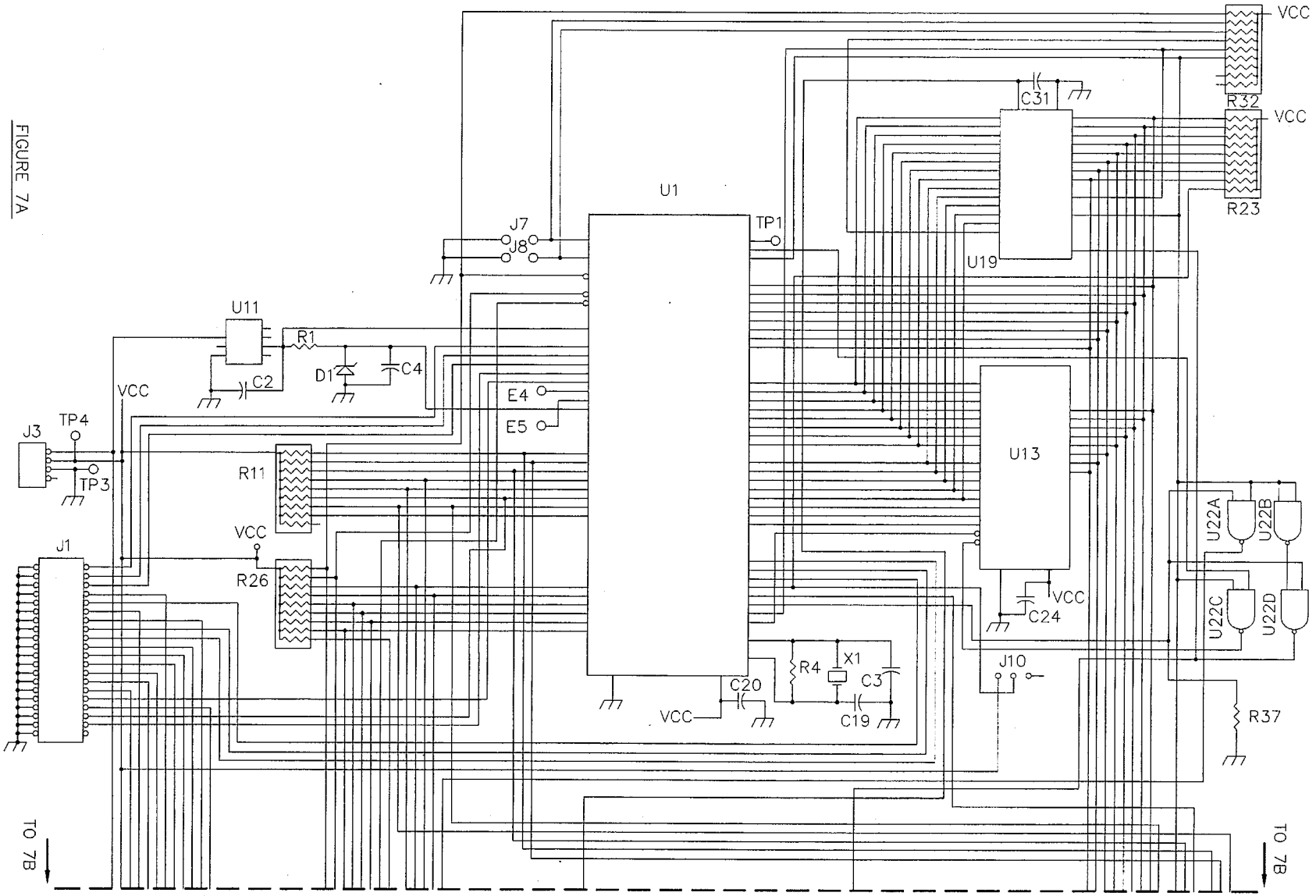
FIG. 7 is a schematic diagram of the microcontroller board.
Figure 7B:
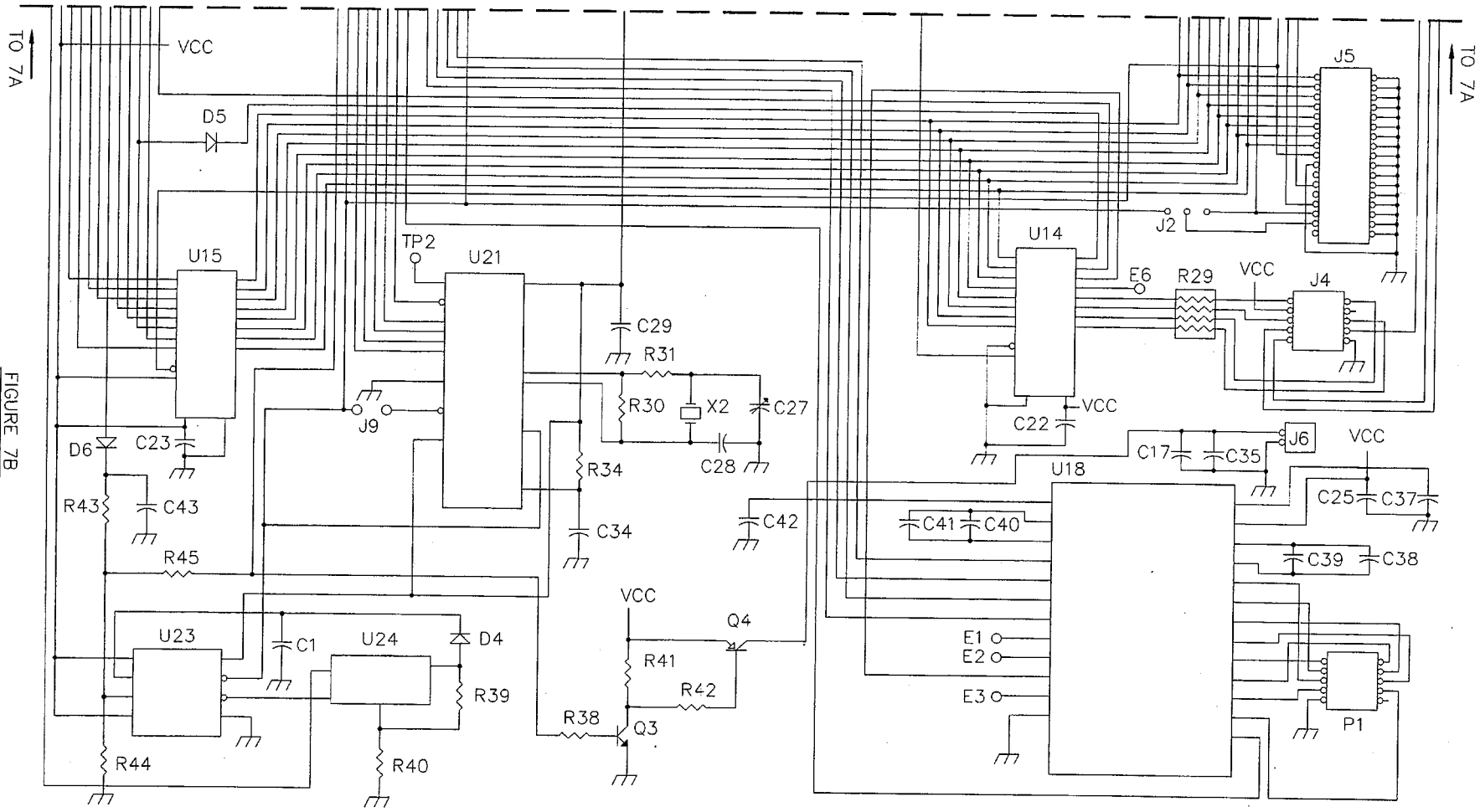

FIGS. 6*a* and 6*b* are a schematic diagram of the interface PCB of FIG. 5 illustrating the isolation interface between the components of the tap changer controller of the invention. As noted above, the circuitry outside of the dotted line shown in the schematic is referenced to line neutral whereas the circuitry within the dotted line is referenced to chassis ground so as to provide sufficient electrical isolation in compliance with applicable standards.

The inputs and outputs of the interface circuit are as labelled at connector P2 in the schematic diagram of FIGS. 6A and 6B. These inputs and outputs are well-known in the art and only those that are relevant to the claimed invention are described in detail.

The Voltage-In at pin 1 of connector P2 is connected through isolation step-down transformer T1 to a voltage regulator U4 whose input is protected by 24 V zener diode D2. Also, the Voltage-In is connected through isolation step-down transformer T2 and is then supplied to pin 39 of connector P4 to be connected to an A/D converter input of the microcontroller.

The Line Current-In at pin 4 of connector P2 is connected through isolation current transformer T3 which steps-down the current and is then supplied to pin 37 of connector P4 to be connected to another A/D converter input of the microcontroller. The controller is provided with a overcurrent blocking feature wherein the maximum current required to be measured is about 640 mA and at the same time a current as low as 4 mA is required to be measured for proper reverse power sensing. Since the A/D converter of the microcontroller is 8-bit, insufficient resolution may result when the input current ranges from 640 mA to 4 mA or less. Accordingly, this portion of the interface circuit provides resolution circuitry to permit resolution of maximum currents on the order of 640 mA from the current transformer (CT) (that is external to the controller and therefore not shown) through T3 to one of the A/D converter channels of the microcontroller (pin 37 of connector P4) and resolution of small currents on the order of 50 mA or less from the CT through another one of the A/D converter channels of the microcontroller (pin 3 of connector P4).

Specifically, this resolution circuitry comprises isolation transformer T3 (e.g., 32/3350 turns ratio) having resistors R11 and R12 respectively connected to opposite terminals of the secondary of the transformer T3 and then to chassis ground. Resistors R9 and R24 are also respectively connected to opposite terminals of the secondary of the transformer T3 and therefore provide two outputs of the input current (to pins 37 and 3 of connector P4). The resistors R9 and R11 are selected (e.g., 1K and 562 ohms) such that resistor R11 drops 5 V peak when supplied with 6.29 mA corresponding to a primary current of 658 mA. The resistors R24 and R12 are selected (e.g., 49.9K and 7.5K ohms) such that resistor R12 drops 5 V peak when supplied with 471.4 μA corresponding to a primary current of 50 mA. These outputs via pins 37 and 3 of connector P4 are supplied to two separate A/D converter channels of the microcontroller and, under software control as described below, are appropriately selected for further processing depending on the magnitude of the input current. It is noted that the zener diodes D8 and D17 (e.g., 6.2 V) protect the A/D inputs.

The Circulating Current Inputs (pins 5 and 6 of connector P2) are connected across the primary of isolation transformer T4 and its secondary is connected to another A/D converter channel of the microcontroller via pin 35 of connector P4. Zener diode D16 provides protection to the A/D converter.

It is noted that the A/D convertor is internal to the microcontroller U1 and each channel of its multiplexer includes protection diodes that will half-wave rectify all of the analog input signals prior to sampling of the input signals. Nevertheless, only the positive half-cycle of the input signals produces non-zero samples due to the unipolar nature of the A/D convertors. The zener protection diodes are necessary on the current channels to protect the A/D from excessive voltages resulting from fault currents.

As disclosed in detail in the U.S. patent application Ser. No. 07/816,242, filed Dec. 31, 1991, the disclosure of which is hereby incorporated by reference herein, because the analog input signals are half-wave rectified prior to sampling by the A/D convertor of the microcontroller U1, a considerable reduction in complexity and cost of the circuit can be achieved. At the same time, there is no significant loss of information because steady-state analog signals in power systems characteristically do not contain even harmonics. Thus, the clipped negative portions of the analog signals are characteristically the mirror image of the positive portion of the signals. Consequently, the sampling of the half-waverect digitization analog input signals does not result in the loss of any significant information. Most importantly, since only the half-wave rectified analog signals are being sampled by the unipolar A/D convertor of the microcontroller, a greater resolution of the sampling is obtained.

The digital inputs to the microcontroller include motor seal-in input, non-sequential input, Voltage Reduction (V.Red) step 1 input, V.Red step 2 input, counter input, and neutral position detection input at pins 13, 17, 18, 9, 11 & 12, and 14 & 15, respectively, of connector P2. These digital inputs are connected through opto-isolators U10, U7, U6, U5, U8 and U9 (e.g., Motorola H11L2) to the digital inputs of the microcontroller via pins 21, 19, 17, 15, 13, and 11 of connector P4, respectively. Finally, the microcontroller also includes digital inputs from opto-isolators U15 and U16 (via pins 27 and 29 of connector P4) of keep-track circuits (described below) that verify that a "raise" or "lower" output, respectively, to the tap changer was actually initiated.

One of the "alarm" digital outputs of the microcontroller is connected via pin 7 of connector P4 to a relay coil of an alarm relay K1 that is actuated by gating transistor Q3 to ground via pin 7 of connector P4. The normally open contacts of the relay K1 are connected to the selectable alarm pins 20 and 22 of connector P2 that are in turn connected to a user programmable alarm output of the adaptor panel (see FIG. 3).

Another of the "alarm" digital outputs of the microcontroller is connected via pin 5 of connector P4 to the relay coil of another alarm relay K2 that is actuated by gating transistor Q4 to ground via pin 5 of connector P4. The normally closed contacts of the relay K2 are connected to the deadman alarm pins 21 and 24 of connector P2 that are in turn connected to a self-test alarm output of the adaptor panel (see FIG. 3).

The "external motor power disconnect" output of the microcontroller is connected via pin 31 of connector P4 to an opto-isolator U11 (e.g., Motorola MOC3022). The switch of the opto-isolator is connected to the motor seal-in disconnect (pin 19 of connector P2) that is in turn connected, as shown in the wiring diagram of the adaptor panel (FIG. 3), through connector P8/J8 to the motor seal-in circuit.

The "raise" and "lower" outputs of the microcontroller are connected via pins 23 and 25 to "raise" and "lower" opto-isolators U2 and U3. It is noted that diode pairs D12 & D13 and D14 & D15 are provided to assure that the opto-isolators U2 and U3 are not both actuated simultaneously thereby preventing conflicting signals to the tap changer motor. Specifically, a logic low at pin 23 (or pin 25) grounds opto-isolator U2 (or U3) to turn it on and causes a "raise" (or a "lower") while grounding the input to the other opto-isolator U3 (or U2) to prevent it turning on. Should both pins 23 and 27 be grounded, neither of the opto-isolators are turned on and neither a "raise" nor a "lower" signal is created.

The switches of the opto-isolators U2 and U3 are respectively connected to the gates of triacs Q1 and Q2. The "Motor Power In" input (pin 8 of connector P2) is connected to main terminals MT2 of the triacs Q1 and Q2. The other main terminals MT1 of the triacs Q1 and Q2 are connected to the "raise" and "lower" outputs (pins 7 and 16) of the connector P2 for driving the tap motor in the respective direction when the respective gates of the triacs Q1 or Q2 are actuated thereby causing a "raise" or "lower" in the tap position.

As noted above, the microcontroller includes digital inputs from opto-isolators U15 and U16 (via pins 27 and 29 of connector P4) of respective keep-track circuits that verify that a "raise" or "lower" was actually implemented as instructed. Most importantly, the keep-track circuits allow the microcontroller to detect a tap change under any condition, such as for example, when the tap change is called for by the controller, external contacts or manual raise or lower.

The keep-track circuits comprise series connected diodes D7 or D9, resistors R33 or R32, zener diodes D18 or D19 connected between the Non-interruptable Power Supply (pin 23 of connector P2) and the LEDs of the opto-isolators U15 or U16, respectively. (It is noted that in practice, the Non-interruptable Power Supply is connected to the Motor Power In). A charge storage capacitor C18 or C15 is connected between the respective zener diodes D18 or D19 and resistors R36 or R37 to main terminal MT1 of the respective "raise" and "lower" triacs Q1 and Q2.

At quiescent conditions, diodes D7 and D9 rectify the AC (120 or 240 V) power supply voltage. Resistors R33 and R32 (e.g., 5.6K ohms) and zener diodes D18 and D19 (e.g., 82 V) form a series voltage regulation circuit that limits the charging current of the charge capacitors C18 and C15 (e.g., 220 μF), respectively, (e.g., to less than 15 mA RMS). Since the LEDs of the optoi-solators U16 and U15 reliably operate at approximately 5 mA, the voltage drop across R36 and R37 will be approximately 2.5 volts that is in series with the voltage drop of 1.7 volts across the respective LEDs, for an approximate total of 4.2 volts. Therefore, the charge capacitors C18 and C15 can only charge up to approximately 4.2 volts before the respective LEDs operate. The RC time constant is chosen to avoid misoperation due to noise transients yet the response time is fast enough to reliably detect rapidly operating tap-changer switches.

When the respective triac Q1 or Q2 is gated to initiate a "raise" or "lower" tap position (or when a switch across the triac's terminals closes as in manually causing a tap change or from external contacts such as SCADA), the voltage across the respective charge storage capacitors C18 or C15 drops to essentially zero. The LED of the respective opto-isolator U16 or U15 is turned off and the output of the opto-isolator U16 or U15 goes high thereby indicating that tap motor has been energized. As described below, the computer program monitors the outputs of the opto-isolators U16 and U15 to determine the direction of tap change. The tap change direction is used along with operations counter input contact (of the motor seal-in input in the case of Cooper regulators) in order to register a tap change and keep-track of the tap position.

Figure 8A:
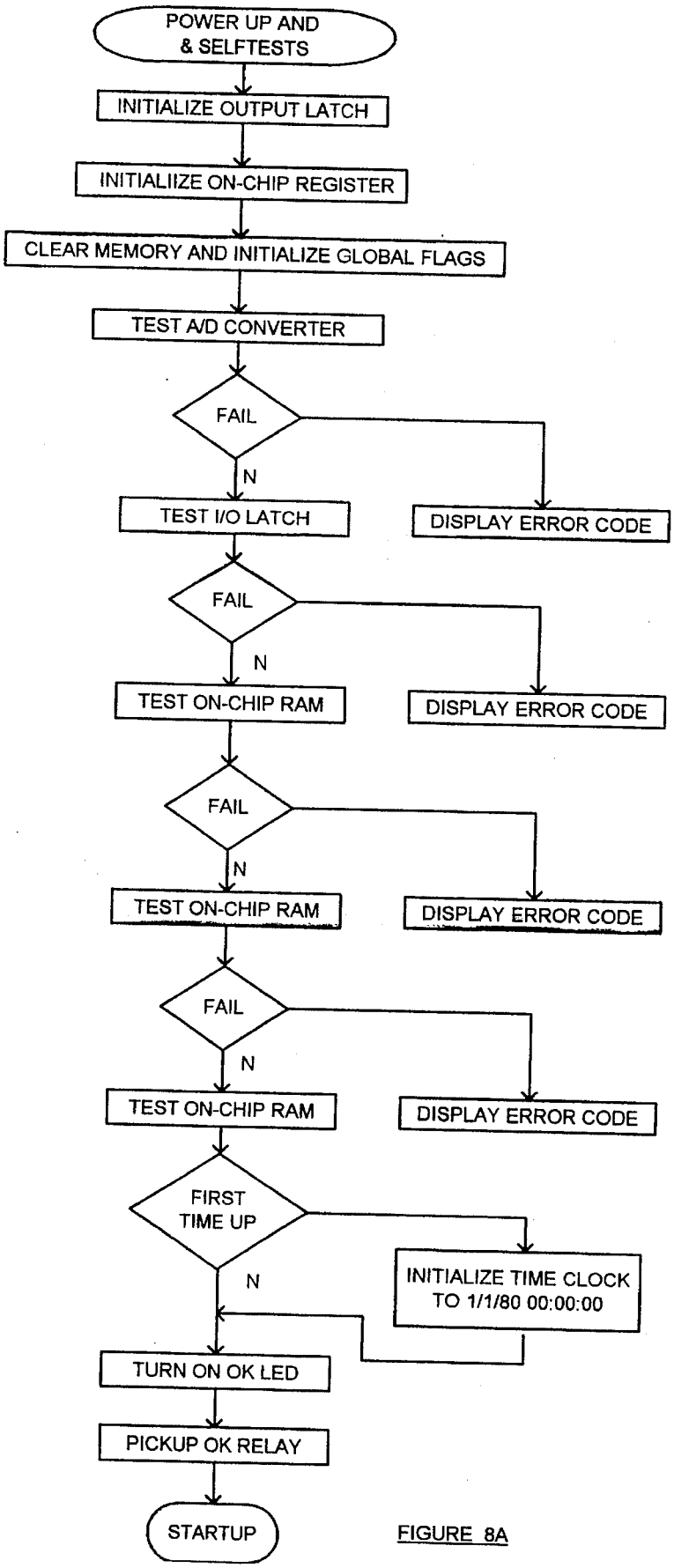
FIGS. 8A–F are flow diagrams of the computer program modules for the power up and self test task, start-up task, user interface task, control logic task, menu dispatch task, and control timer task, respectively, of the computer program.
Figure 8B:
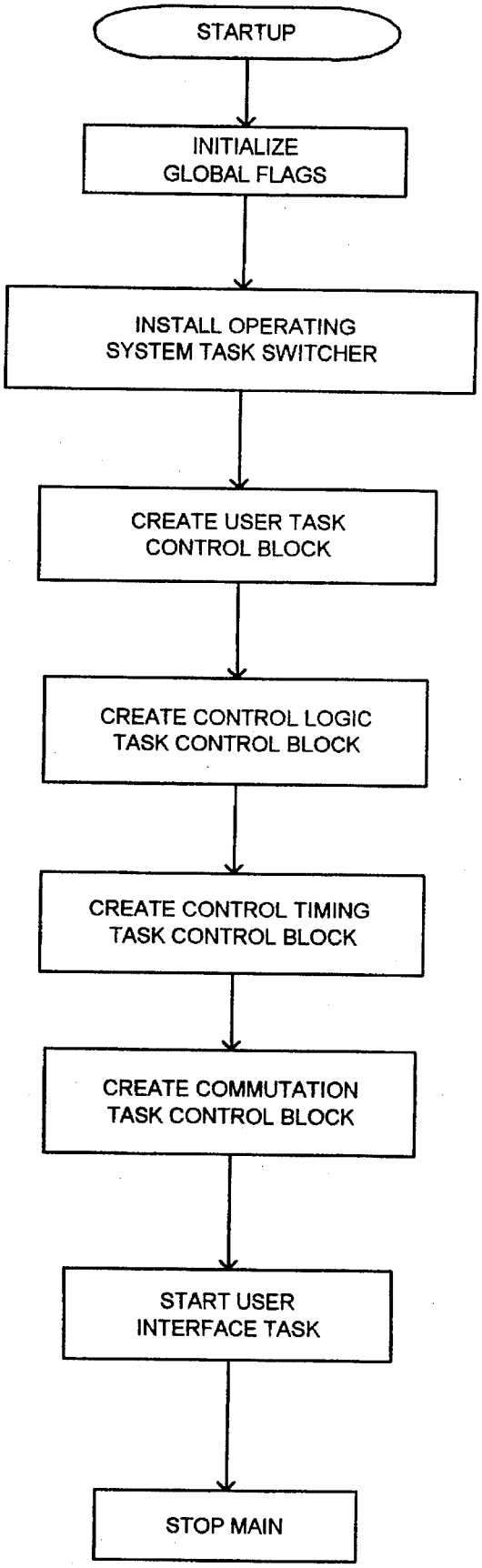
Figure 8C:
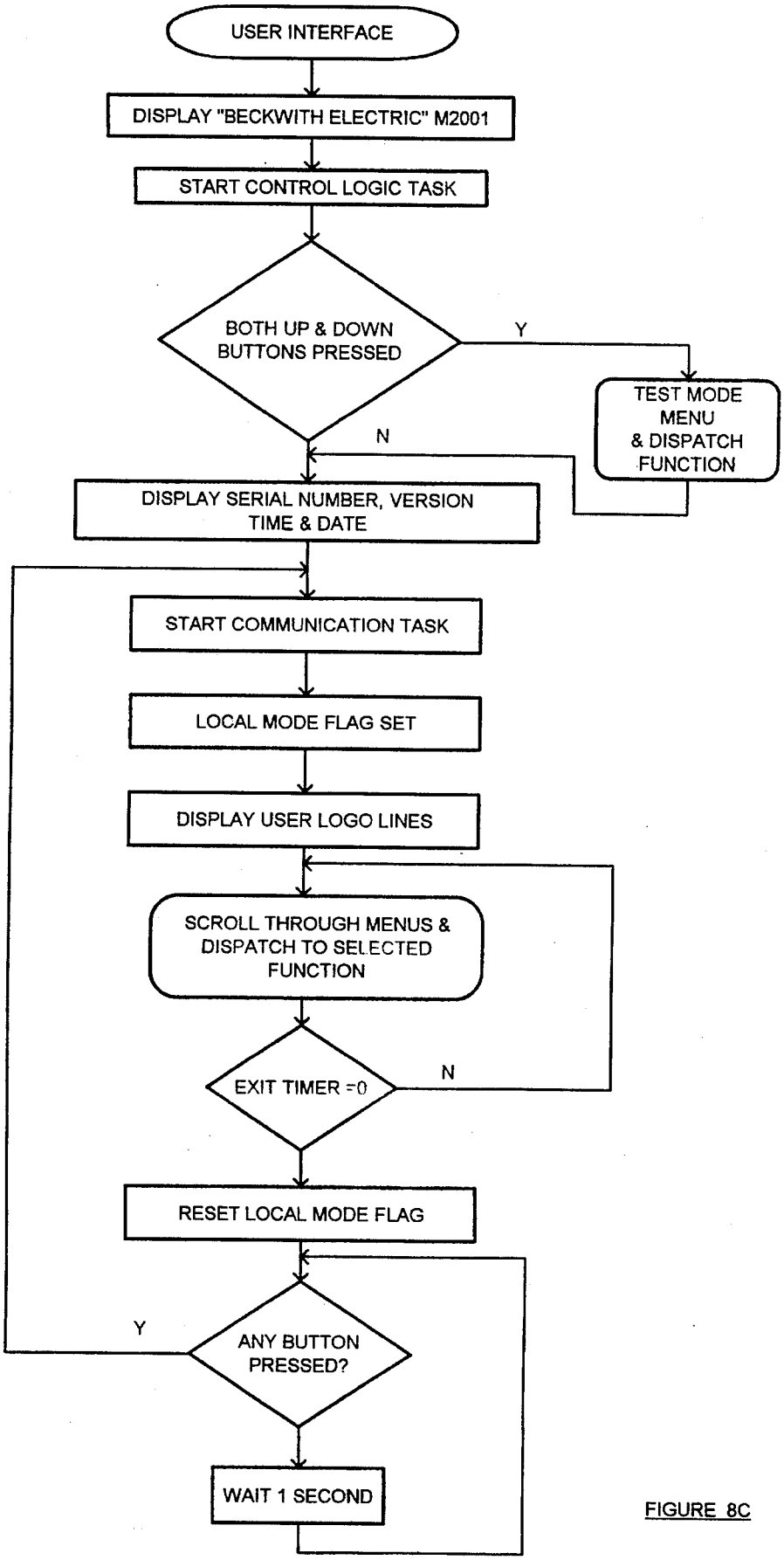
Figures 1, 8D:
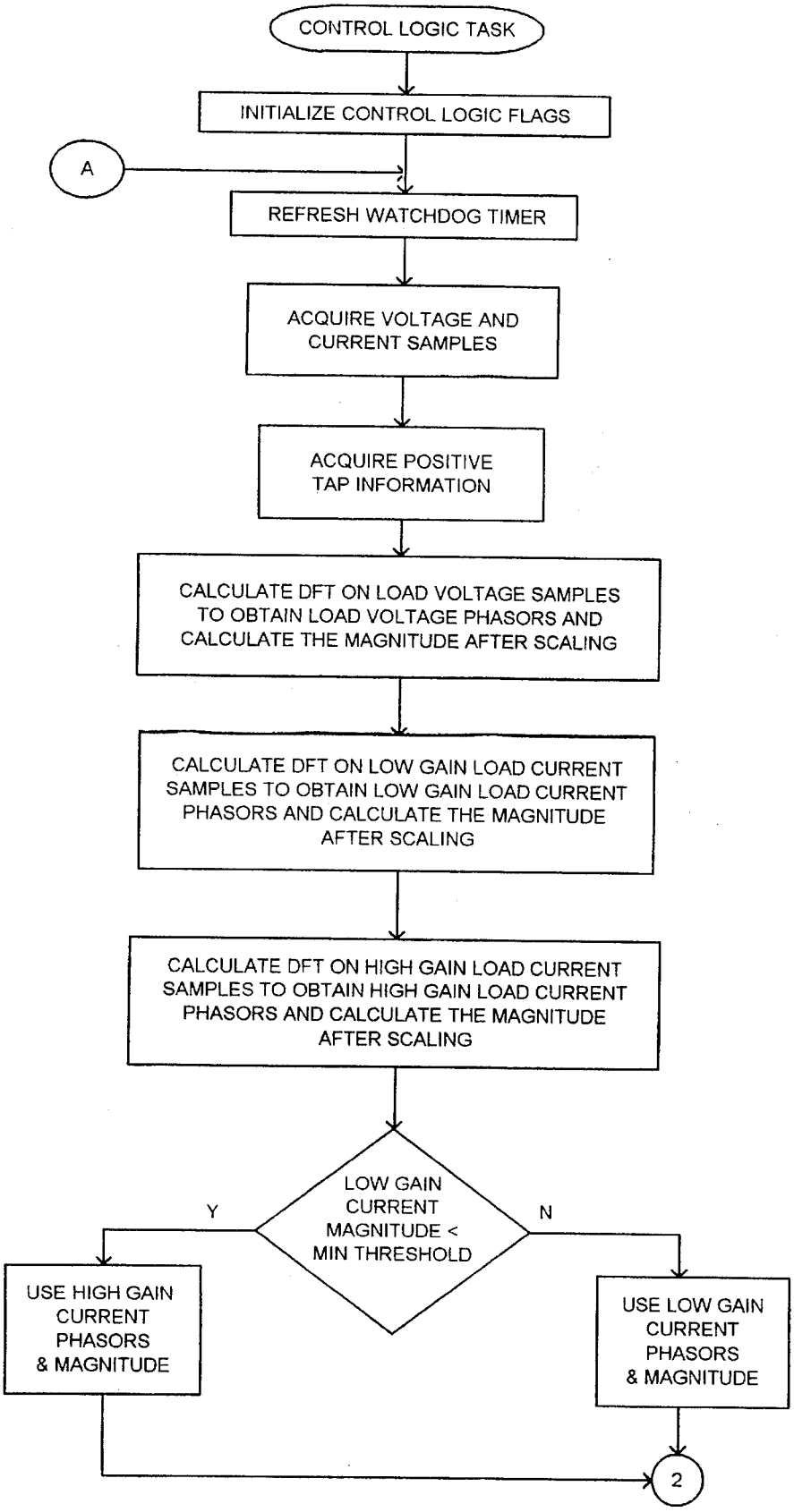
Figures 2, 8D:
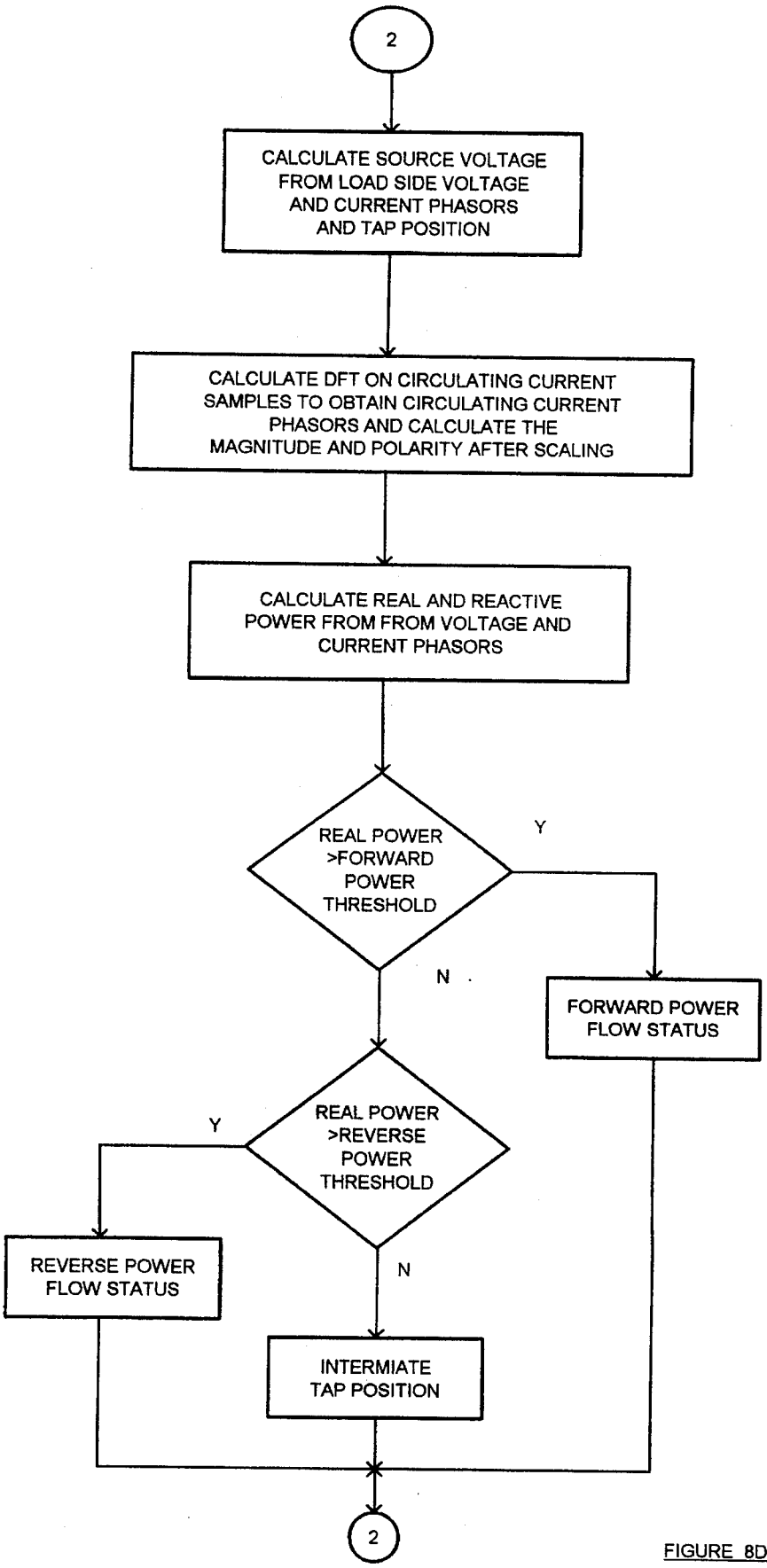
Figures 3, 8D:
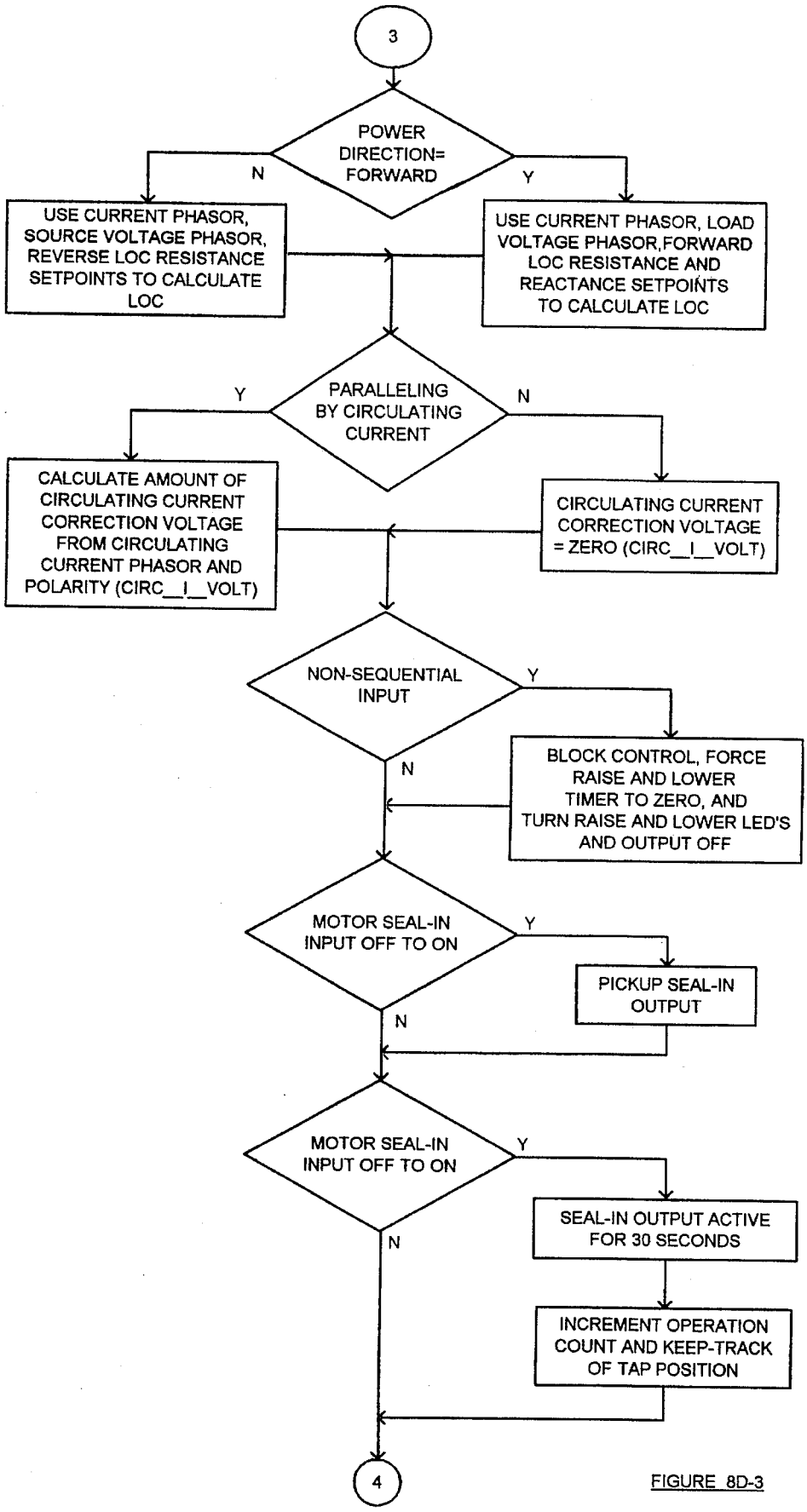
Figures 4, 8D:
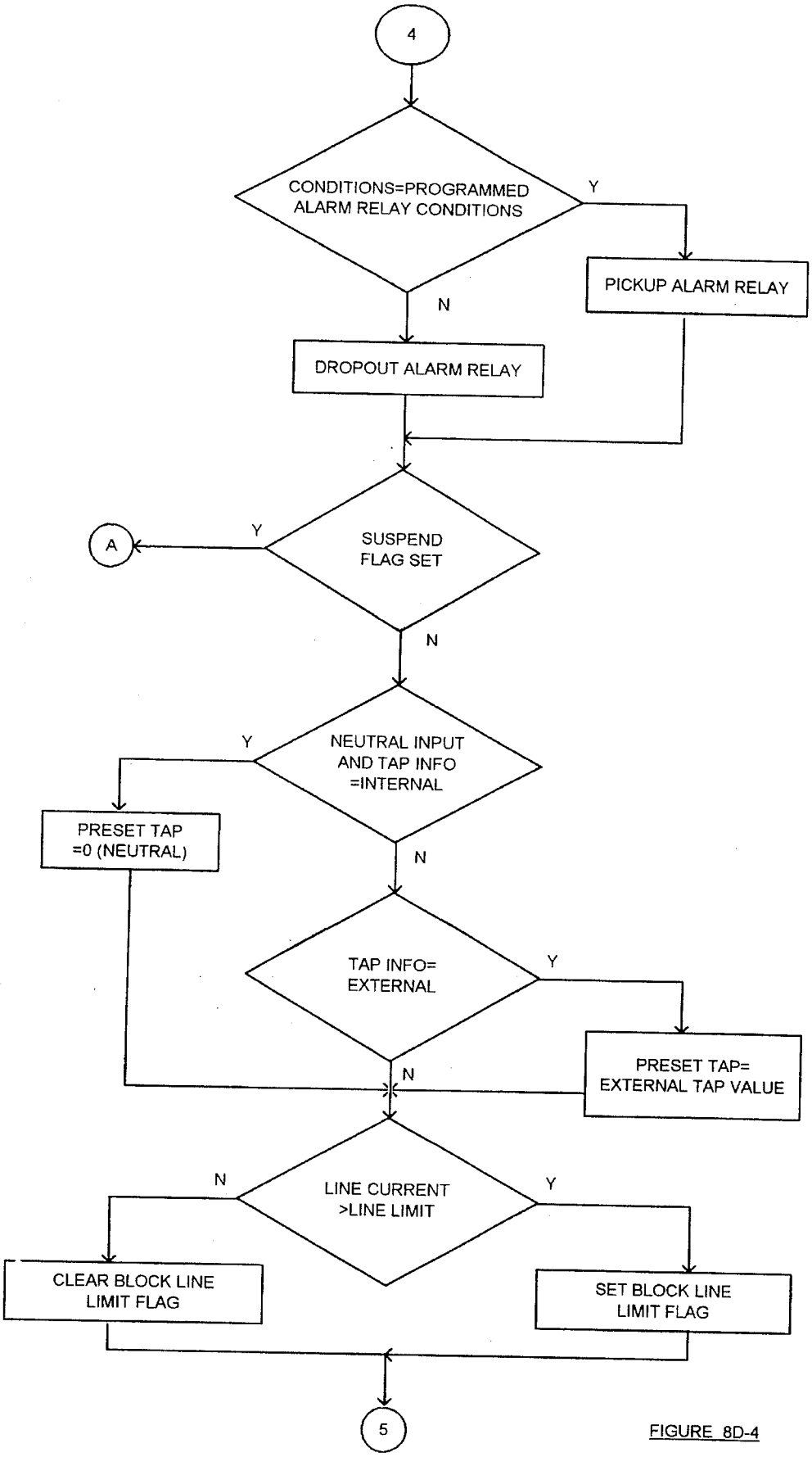
Figures 5, 8D:
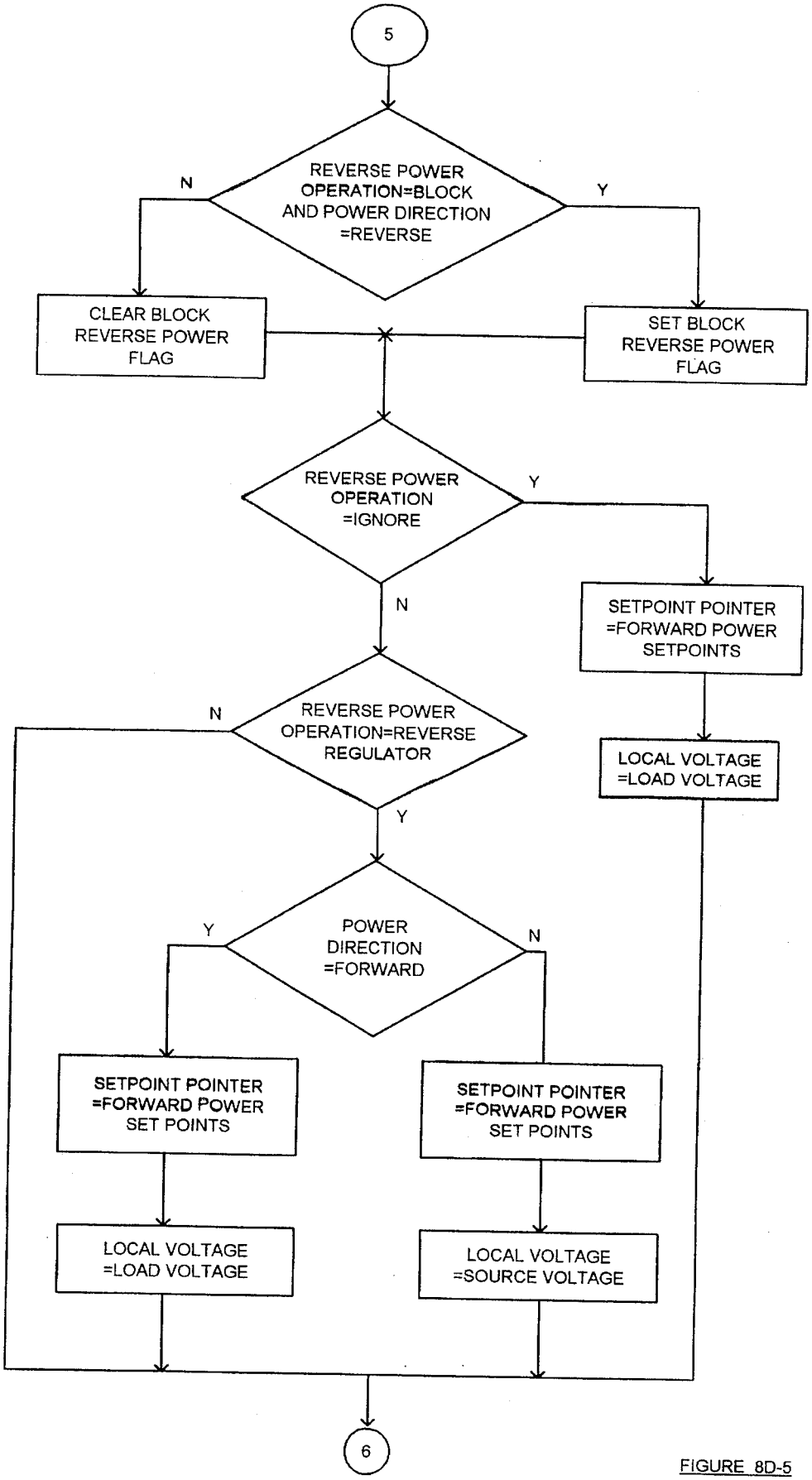
Figures 6, 8D:
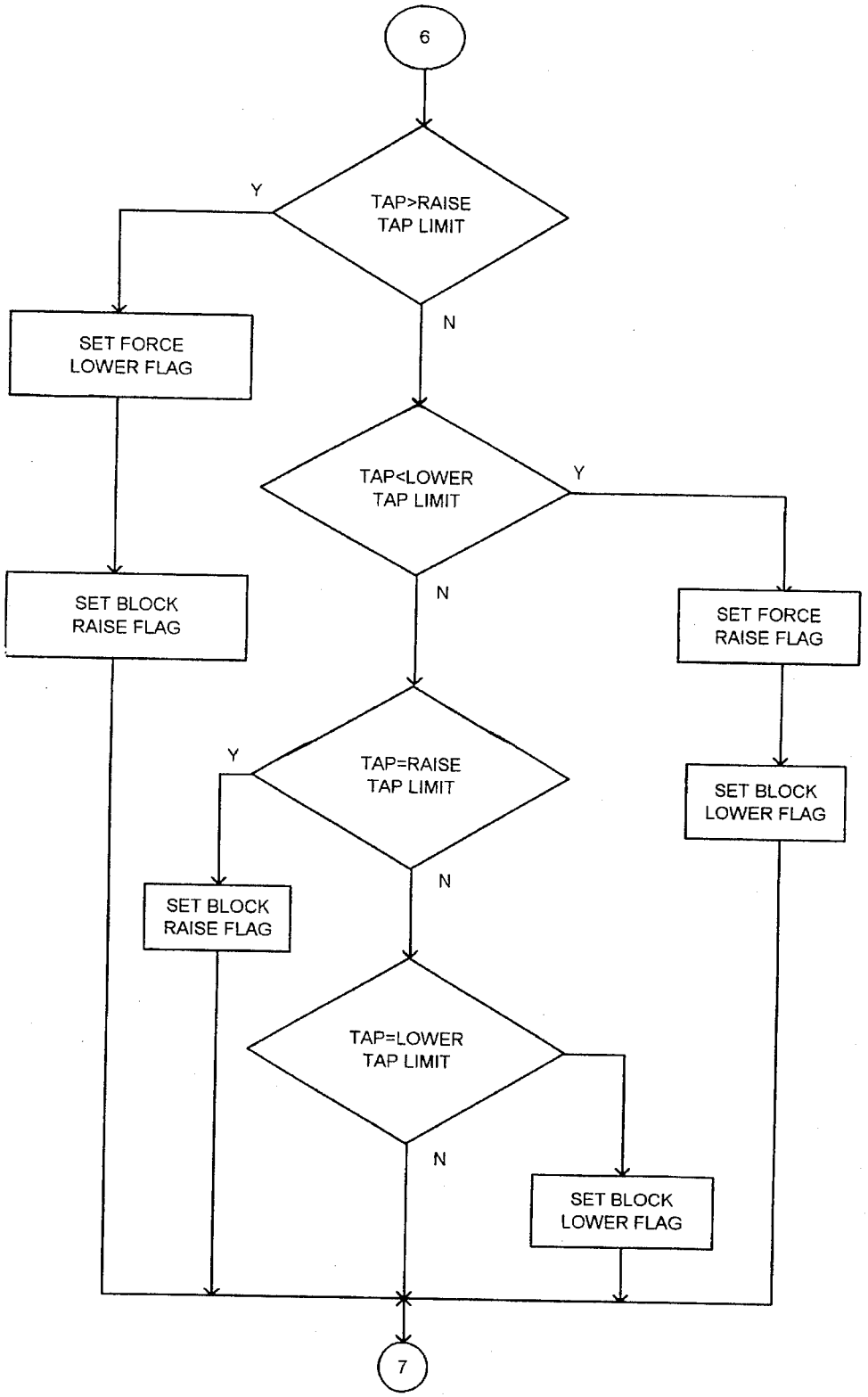
Figures 7, 8D:
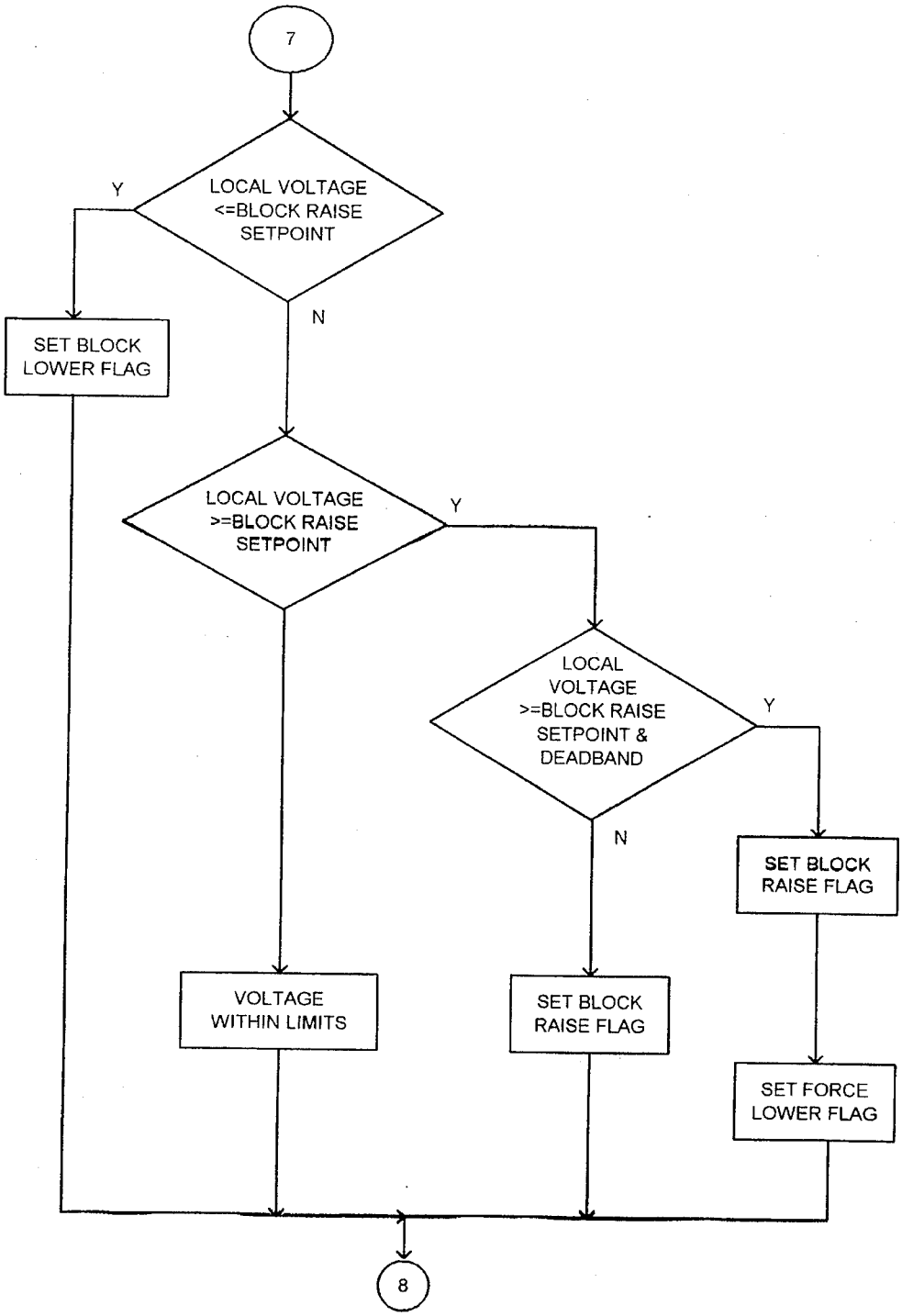
Figures 8, 8D:
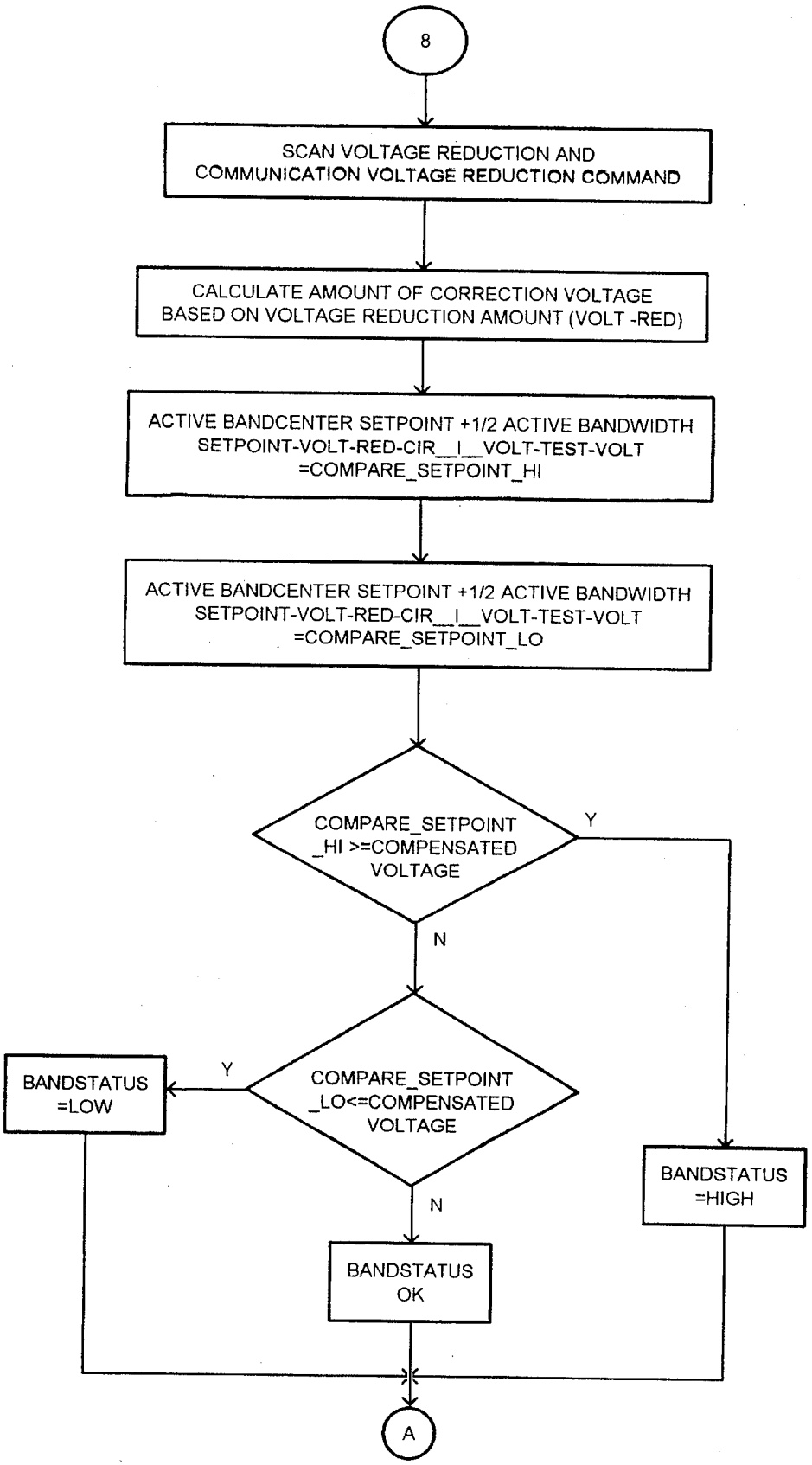

FIG. 7 is a schematic diagram of the microcontroller and associated components employed within the tap changer controller of the invention. It is noted that this schematic diagram is specific to the Motorola MC68HC11 microcontroller and therefore it should be appreciated by those skilled in the art that suitable modifications would be required in the event that a functionally equivalent microcontroller was utilized in lieu of the Motorola MC68HC11 microcontroller. It is also noted that the interface of the components to the microcontroller are well known to those skilled in the art and therefore a detailed explanation is unwarranted.

More specifically, a real time clock U21 (e.g., Motorola MC68HC68T1) is interfaced to the microcontroller U1. A large capacity capacitor C1 (e.g., 1.0F) provides back-up power to the clock U21 during loss of supply power. The capacitor C29 also provides power to RAM memory U19 (e.g., LH5168HD) interfaced to the microcontroller U1.

A serial transceiver U18 (e.g., Linear Technology LT 1237A family) is interfaced to the microcontroller U1 to provide for serial communications with the controller. Finally, a supervisory circuit including a watch-dog timer U23 (e.g., Maxim MAX692) is interfaced to the microcontroller U1 to reset the microcontroller U1 if the timer is not refreshed within a preset timeout period as the result of a inescapable software loop or the like or if a power fail is detected.

The software employed within the microcontroller of the tap changer controller of the invention employs a real-time operating system known as "C-Task" that has been ported to operate on the specific microcontroller employed (i.e. MC68HC11 Microcontroller). The C-Task operating system decides which task to execute on the microcontroller and performs the required context switches. It also handles the hardware interrupts that normally announces the availability of fresh input and determines when the response task is to be activated. In short, the operating system schedules all processor work. The operating system "tic" is controlled by the microcontrollers' real-time interrupt. This timer is programmed for about 16 ms interrupts.

The computer program of the microcontroller of the invention can be divided into four tasks listed below (and described below in detail). As shown in the following table, each of these tasks is assigned a priority, with the higher priority pending tasks guaranteed to be executed first by the operating system:

| TASK | NAME | PRIORITY |
|---|---|---|
| Task 1 | Control logic | High |
| Task 2 | Control timer | High |
| Task 3 | Communication | Medium |
| Task 4 | User Interface | Low. |

The operation of these tasks are illustrated in the flow diagrams of FIGS. 8A–8G. Correspondingly, FIGS. 9-1 through 9-16 illustrate the menus and screens of the computer software including the status menu, status screens, bias test voltage screen, setpoint menu, setpoint screens, configuration menu, configuration screens, programmable alarm function screen of the user interface via the vacuum fluorescent display and the push buttons on the front panel of the controller.

More particularly, the power-up and self-test module of the computer program is shown in FIG. 8A. Upon power-up, this module initializes the output latch, initializes on-chip registers, clears memory and initializes global flags, and tests the A/D converter. An error code is displayed if any failed condition is detected. The input/output (I/O) latch is then tested and error code is displayed if the test fails. On-chip and off-chip RAM are then tested and error codes displayed if either fails. The real time clock is tested and if it is being powered up for the first time, it is initialized. The "ok" LED is then turned on along with the "deadman" relay also known as the "self test" relay.

As shown in FIG. 8B, the start-up module of the computer program is then executed. All of the global flags are initialized. The operating system task switcher as described above is installed. The user task control block, control logic task control block, control timing task control block, and the communications task contol block are each created. Then, the user interface task is started.

Figure 8E:
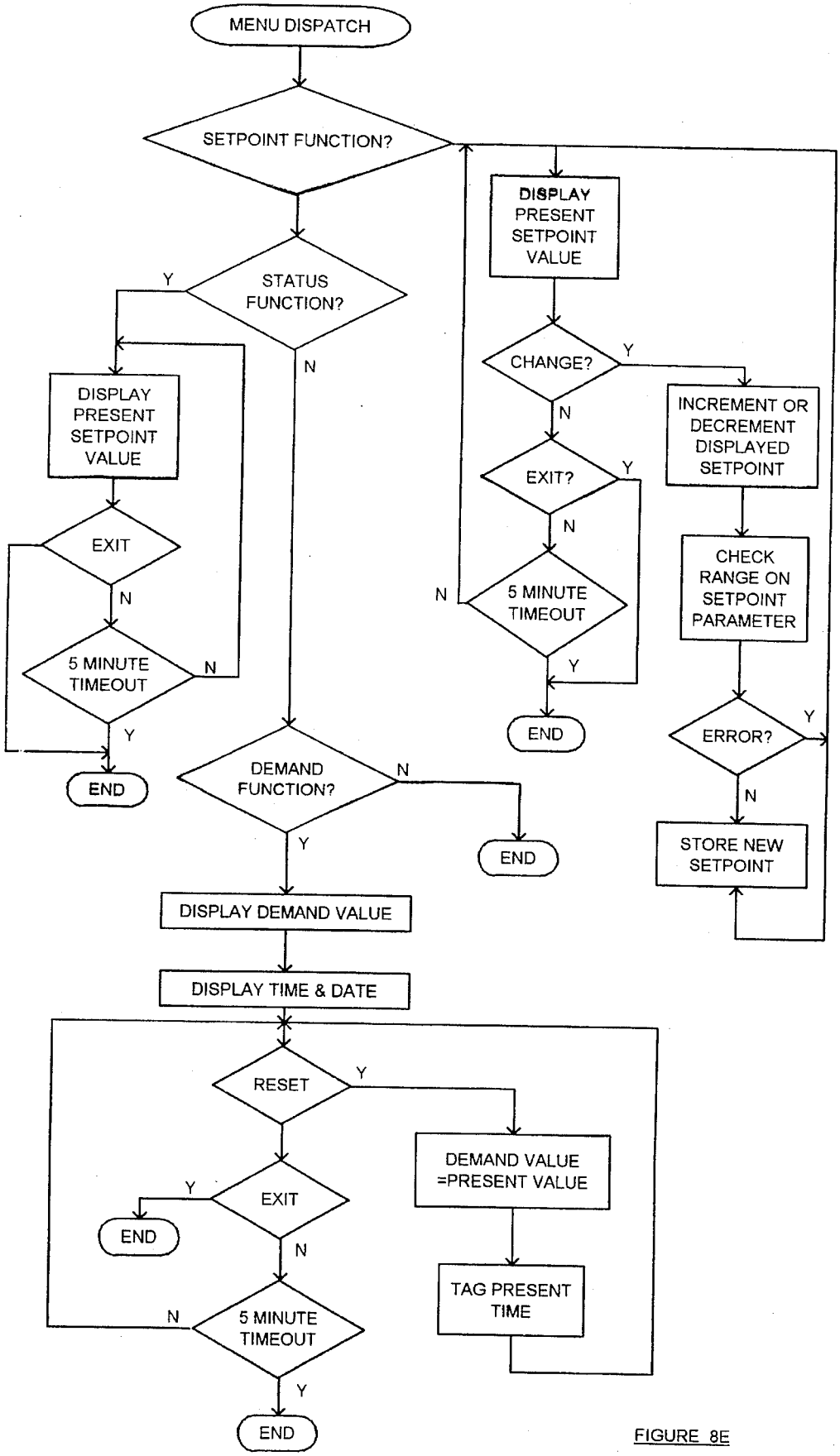

As shown in FIG. 8C, the user interface task starts the control logic task (see FIG. 8D) and the communication task (see FIG. 8E). A diagnostic mode can be initiated by the user by pressing both of the "up" and "down" buttons at power up. The user may scroll through the menus and dispatch to the selected menu (see FIG. 8F). However, if there is no user activity within a preset period, a timer times out and the display blanks.

Figures 1, 2, 9:
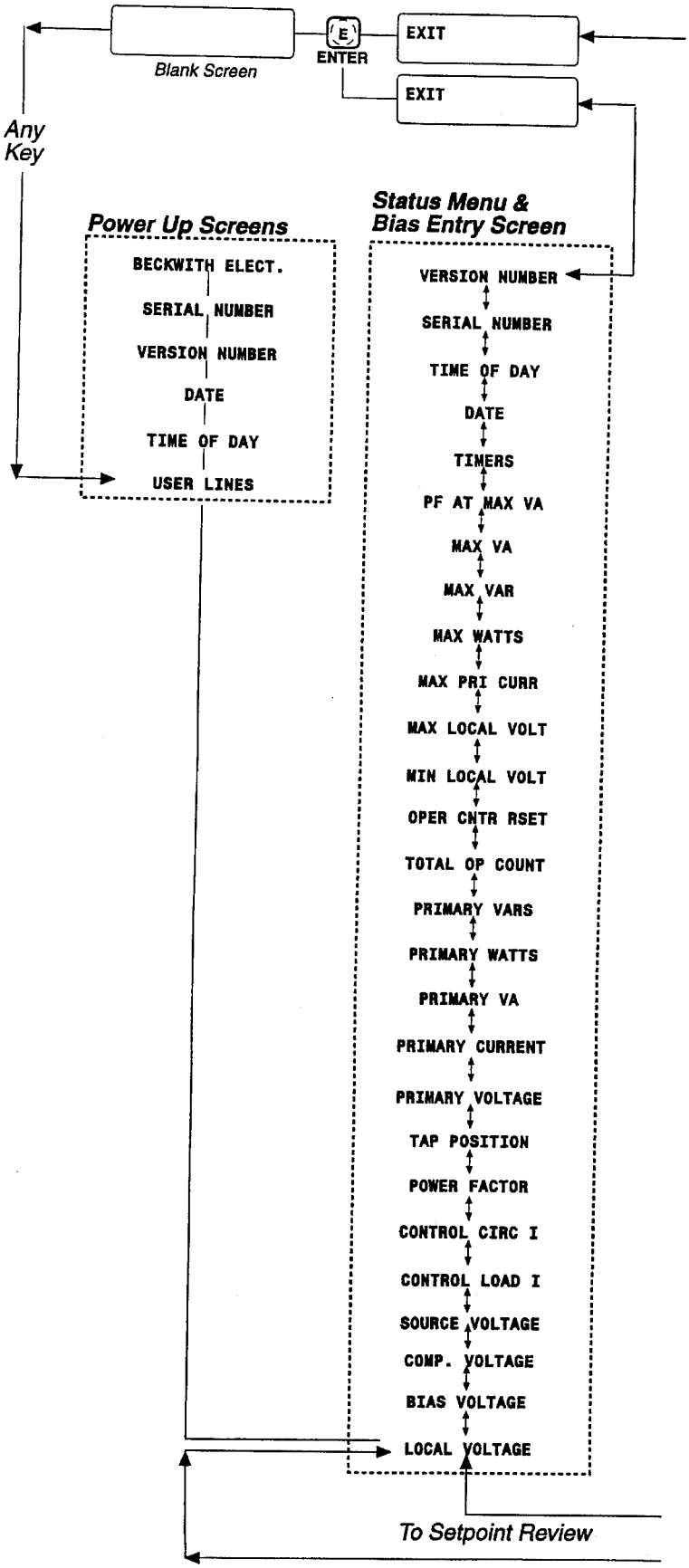
Figures 1, 2, 9:
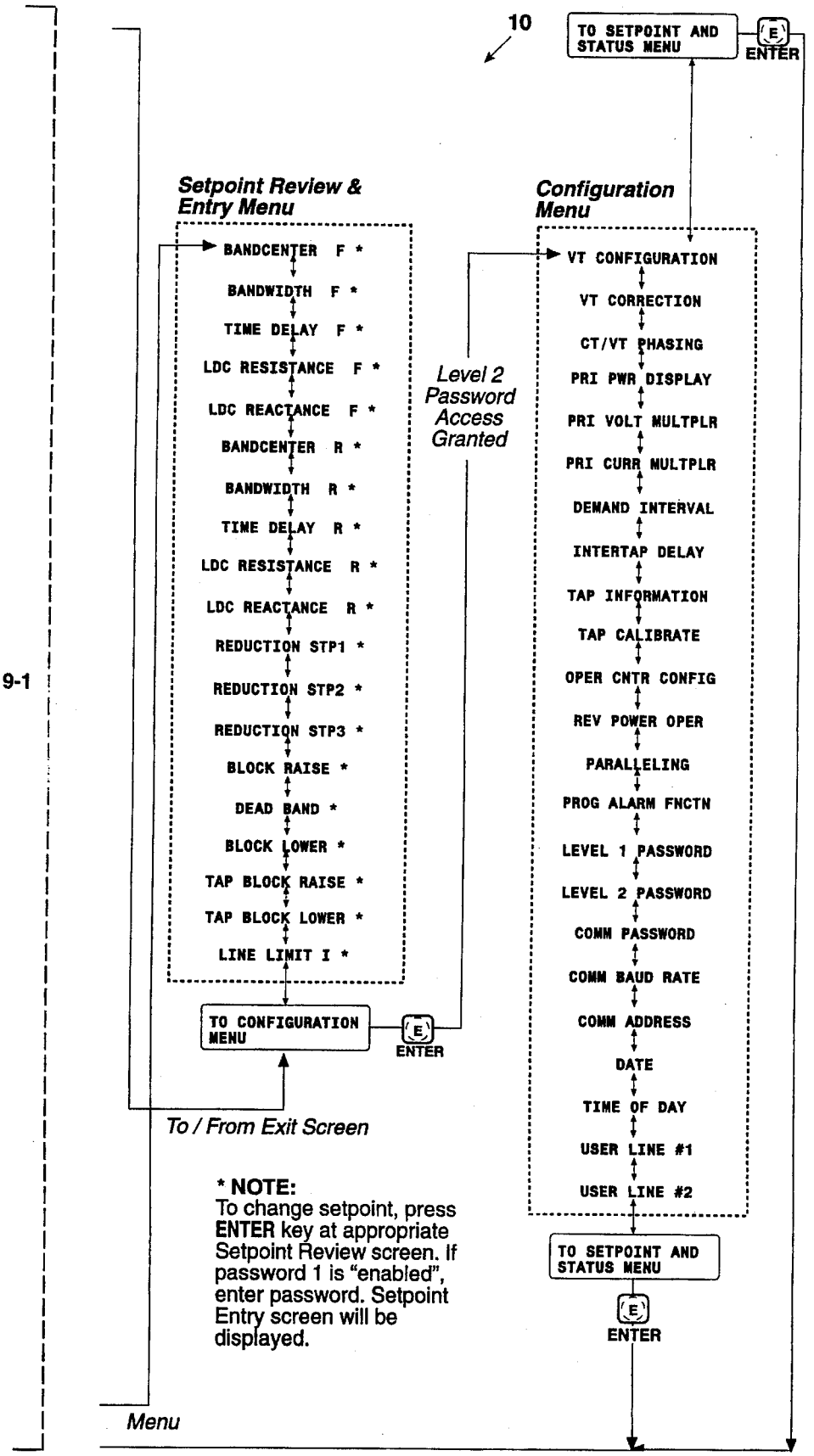
Figures 3, 4, 9:
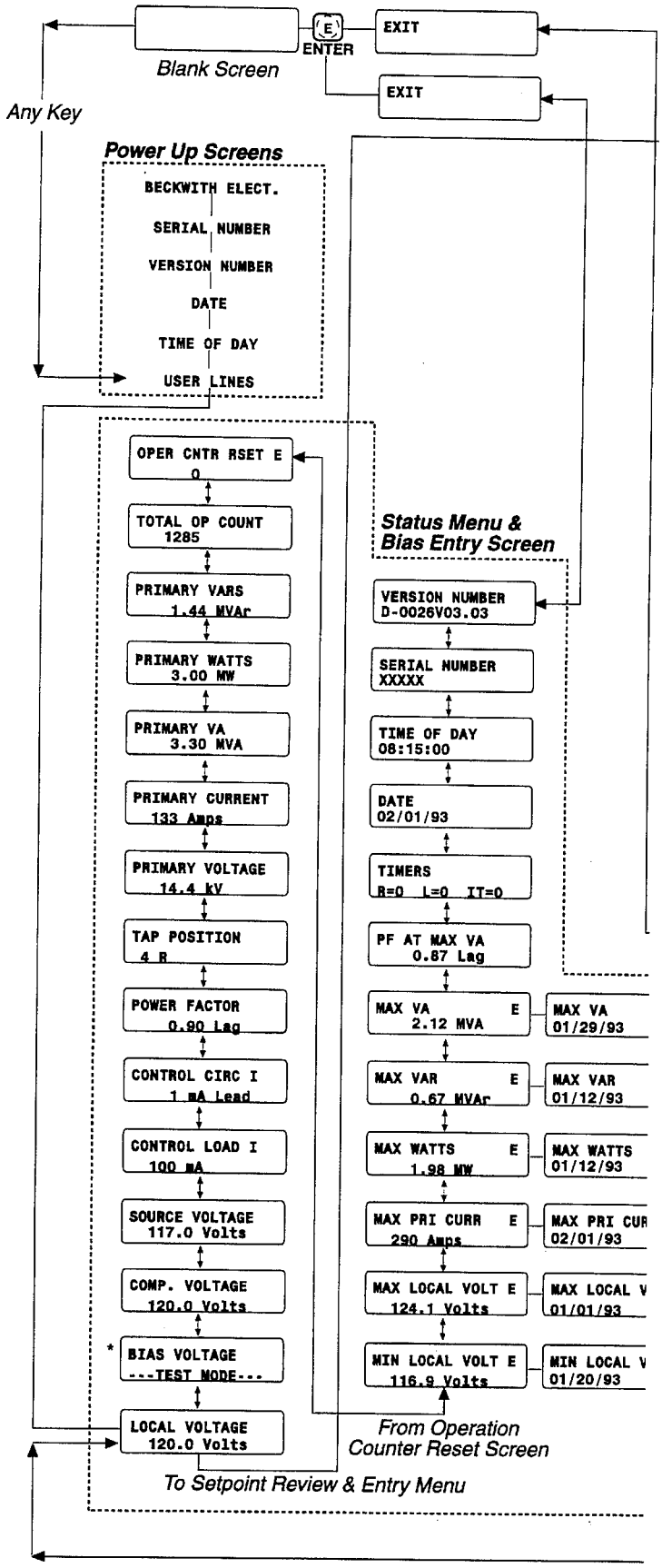
Figures 3, 4, 9:
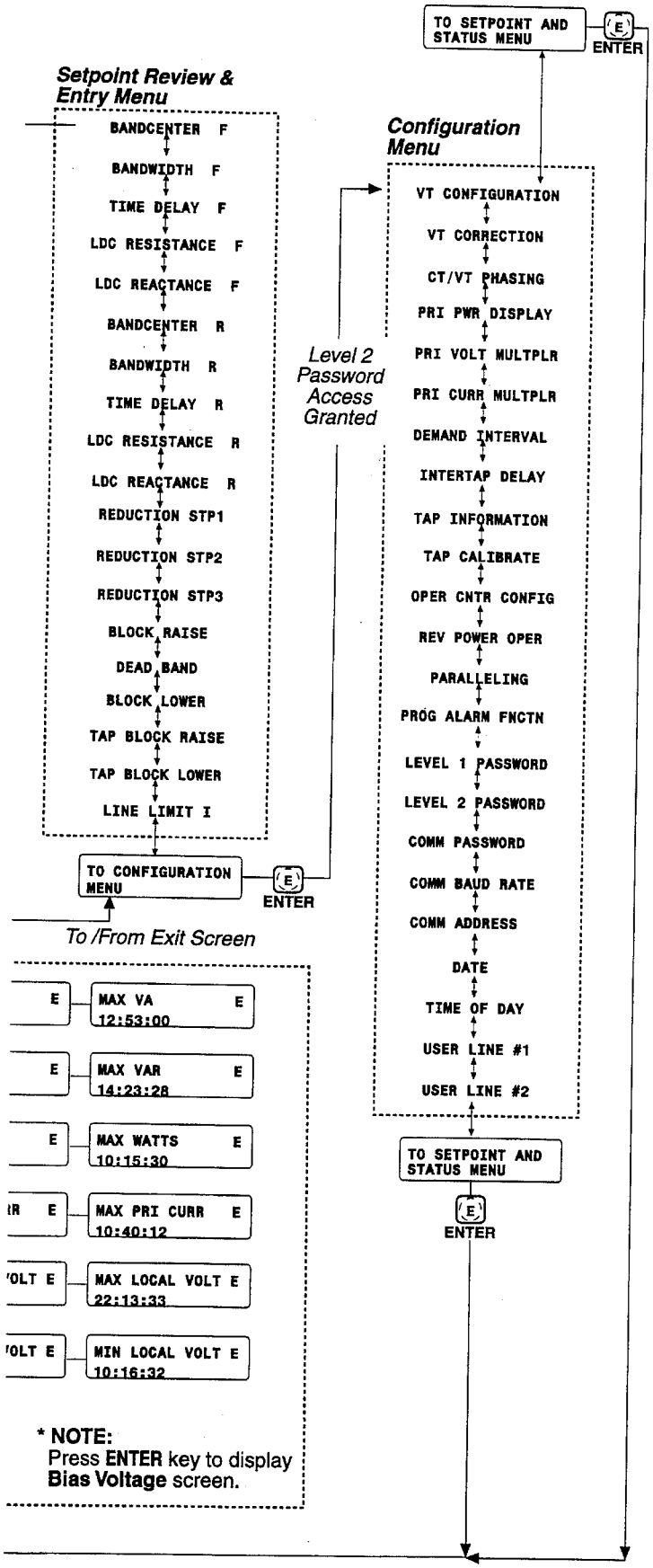
Figures 8, 9:
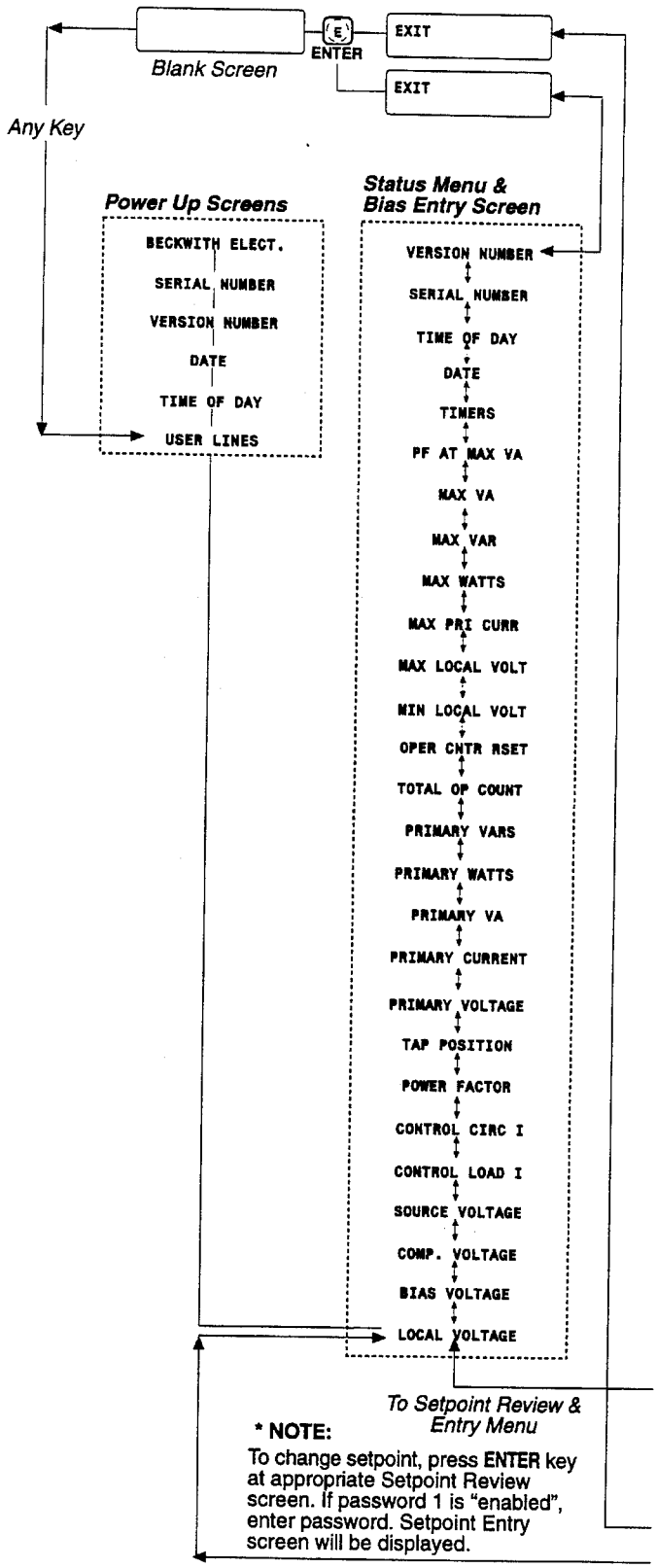
Figures 8, 9:
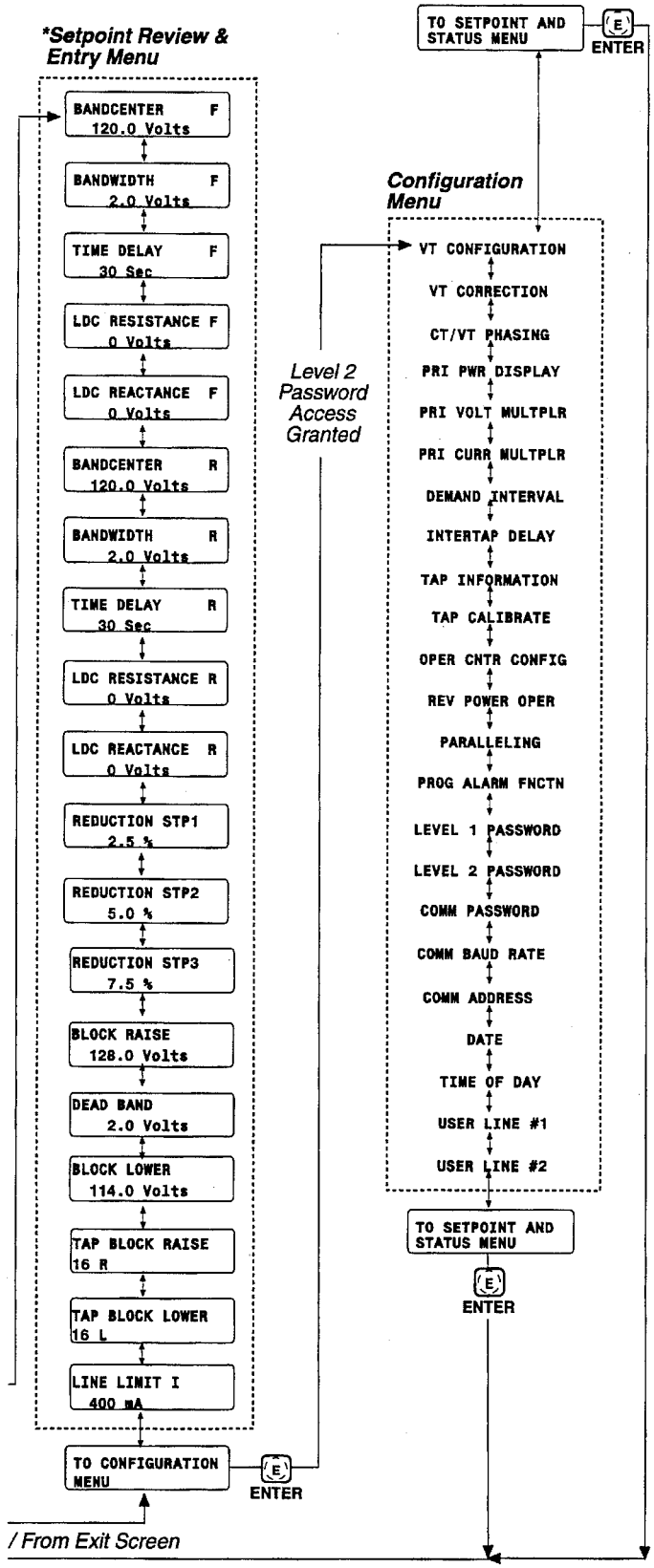

The user interface task and its menu dispatch subroutine manages all interaction with the user. It monitors the 3-button keyboard and controls the 2 line×16 character vacuum fluorescent display. All setpoints and status values are interrogated through this task. The user can scroll through menus by pressing the "up" or "down" buttons as desired and then select the desired parameter by pressing the "enter" button. FIG. 9 illustrates the preferred menus. A more complete description of the use of the "up", "down" and "enter" buttons can be found in , pending U.S. patent application Ser. No. 08/080,822, filed Jun. 24, 1993, which is hereby incorporated by reference herein.

The menu subroutine (see FIG. 8F), dispatch-tables routes control to the proper function. If a setpoint function is selected, the present value is displayed and a new value can be entered if the proper password code was previously entered. The new value range is checked and, if within limits, the new setpoint is stored in non-volatile RAM.

Status values are continuously updated within the menu dispatch subroutine of the user interface task so the most recent value is always available. Demand draghand values (maximum and minimum values since last reset) can be reset by scrolling to its function screen and pressing the "enter" key. Present timer, tap position, voltage, current, power, etc. values can be viewed. Thus, it can be seen that all setpoints and setup parameters are entered through the user interface.

FIG. 8D is a flow diagram of the control logic task of the computer program. In general, the control logic task handles acquisition of the voltage and current samples, computes the signal phasors using discrete Fourier transform (DFT) on the samples and then scales them to derive phase and amplitude information. Real and reactive power is computed from the load current and voltage phasors. From the sign of the real power value, power direction is determined. Proper set points for forward and reverse power operation can then be used. Line drop compensated (LDC) voltage phasors are calculated from the measured load voltage and load current phasors and the programmed LDC setpoints. A proportional correction voltage is calculated from the measured circulating current. Comparing the present tap against tap limits and the local voltage against block operation and runback limits are also performed in this task. Further, voltage reduction calculations as well as comparing the compensated voltage against the programmed bandlimits are also performed.

More specifically, during the control logic task of FIG. 8D, the control logic flags are initialized, the watchdog timer is refreshed and the load voltage, low load current, high load current and, if present, circulating current samples are each acquired from the A/D converter of the microcontroller.

Preferably, 16 samples are acquired during each cycle of each of the load voltage, low load current, high load current and circulating current. Also preferably, the sampling is performed over 8 cycles of the Voltage-In, low Current-In, high Current-In and circulating current. The 16 samples over the 8 cycles are each respectively summed so as to provide a "normalization" of the respective 16 samples over the 8 cycles. It is noted, however, that the normalized samples must be scaled downwardly by a factor of 8 to obtain an average over the 8 cycles. Finally, it is also noted that since half-wave rectified signals are being sampled, half of the samples will be zero.

Figures 9, 10, 11, 12, 13:
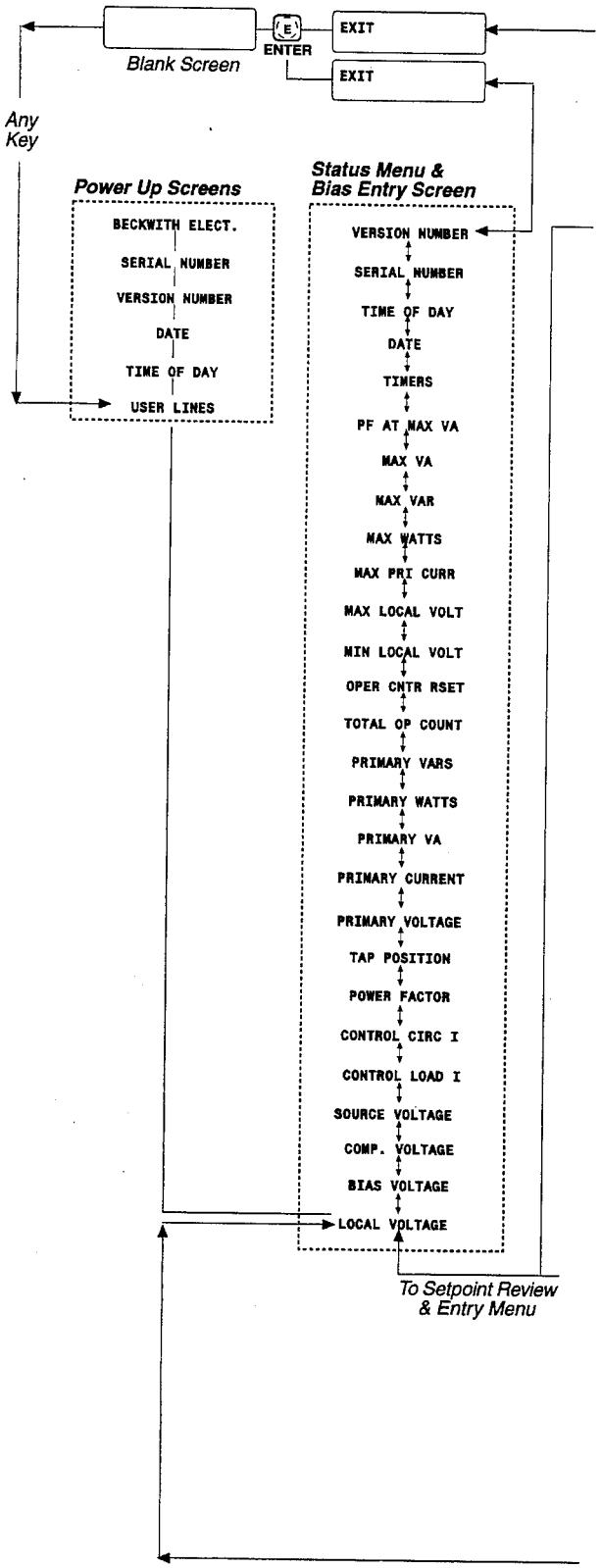
Figures 9, 10, 11, 12, 13:
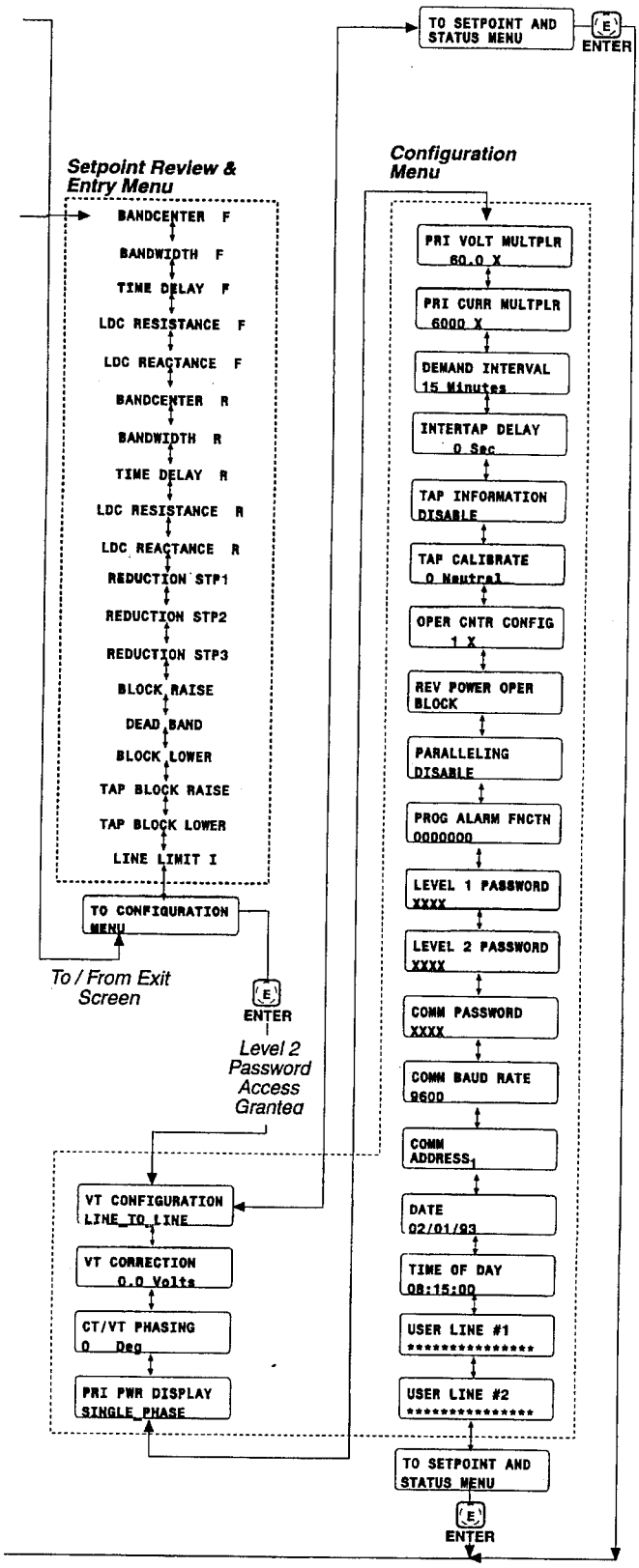
Figure 10:
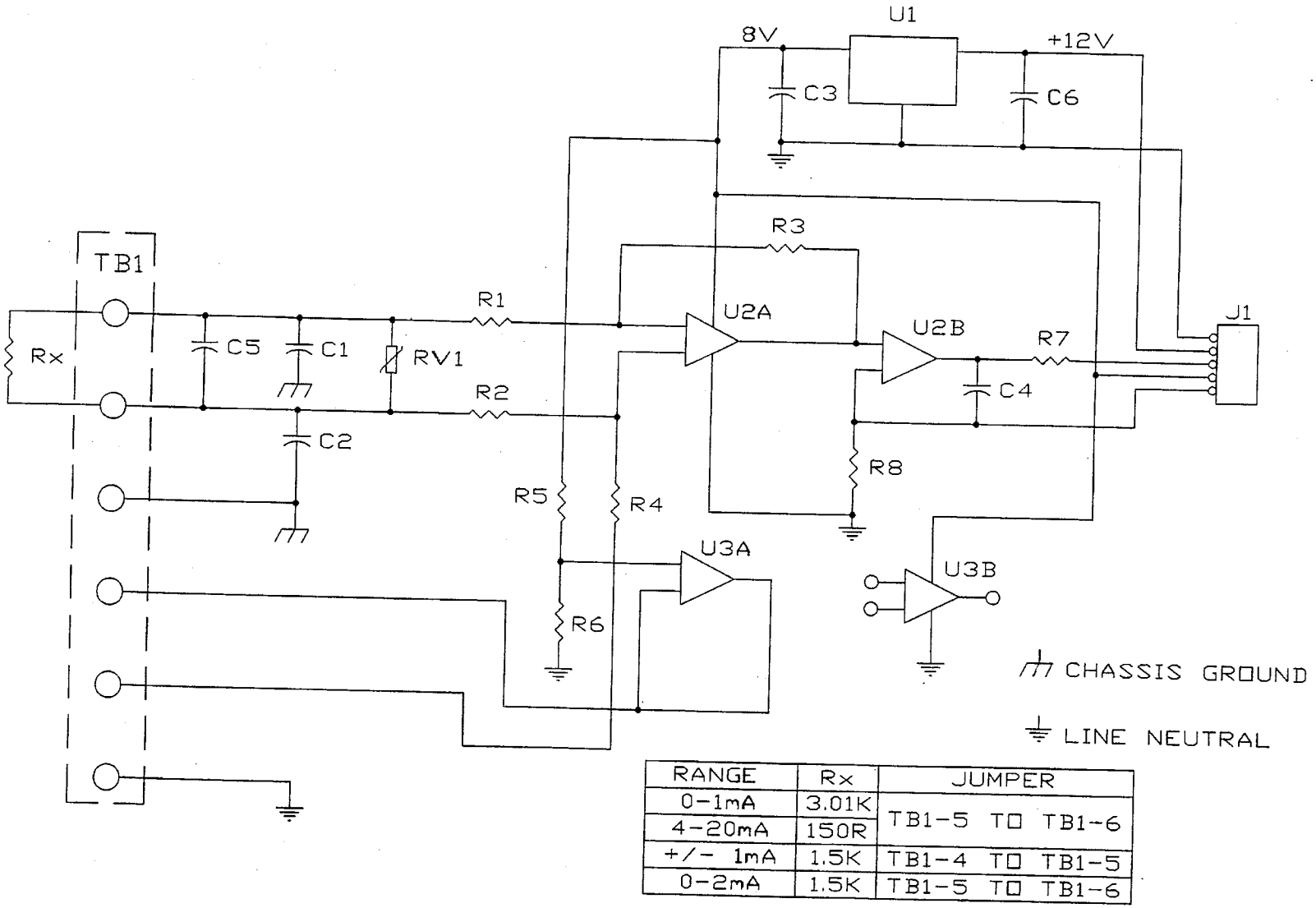

At this point, it is noted that some models of tap changers include a tap position transducer (e.g., Incon Model 1250). As shown in FIG. 10, the controller of the present invention includes a circuit designed to interface the current loop of the transducer to the analog voltage tap position input of the controller. The current loop circuit accepts unipolar inputs of 0 to 1 mA, 0 to 2 mA, and 4 to 20 mA and accepts bipolar current loop input of −1 to +1 mA. The output can be scaled for use with an analog voltage input of 0 to +5 volts. The output is connected through pin 3 of connector J1/P1 to a linear optocoupler U14 (e.g., IL300) on the interface PCB (see FIGS. 6*a* and 6*b*). The output of the linear optocoupler is then connected through pin 9 of connector P4/J4 to another of the A/D converter channels of the microcontroller U1 (see FIG. 7).

During initial calibration, the correct range calibration resistor Rx is selected and then the tap position value in the controllers' configuration menu (see FIG. 9) is changed to match the tap position shown on the transducer. Once calibrated, the tap position is determined from the data by reading that channel of the A/D converter and may be displayed, after scaling, to the user when desired.

As mathematically described below in detail, a discrete Fourier transform (DFT) is performed on the load voltage samples and then on the low and high load current samples to obtain voltage and current phasors. The calculated phasors are digitally calibrated for gain and phase angle errors.

As known in the prior art, when describing a DFT, it can be assumed that the analog inputs are sinusoidal signals corrupted by noise. Using the notation:

$z_k$=the sampled value of signal z(t) at k-th instant, and

N=the number of samples (e.g., 16) in one cycle of the fundamental frequency, the computation of real and the imaginary components of the complex phasor are:

$$ZR_k=\frac{2}{N}\sum_{r=0}^{N-1} z_{r_k}\cos\frac{2\pi r}{N}$$

$$ZI_k=\frac{2}{N}\sum_{r=0}^{N-1} Z_{r_k}\sin\frac{2\pi r}{N}$$

where $Z_{-1}, Z_{-2}, \ldots Z_{-(N-1)}=0$ and N=16 samples per cycle. The magnitude |Z| and phase angle (θ) of the phasor can be obtained as follows:

$$|\bar{Z}|=\sqrt{ZR^2+ZI^2}$$

and $$\theta=\tan^{-1}\frac{ZI}{ZR}$$

The RMS value of $Z_{RMS}$ of the fundamental frequency component is given by:

$$Z_{RMS}=\frac{|\bar{Z}|}{\sqrt{2}}$$

The source voltage from the load side voltage and load current phasors and tap position are then calculated as follows:

$$\bar{V}_S=\bar{V}_L[1-T.P.\times T.R.]+\overline{I_L Z_R}$$

where $V_S$ is the source voltage in P.U., $V_L$ is the load voltage in P.U.,

T.P. is the tap position (−16 to +16) obtained from keep-track method for "raise" and "negative" for "lower"), T.R. is based on the turns ratio per tap (i.e., 0.00655833), $I_L$ is the load current in P.U., and $Z_R$ is the P.U. impedance of the regulator (a typical value of 0.0015+j0.0053 is used).

Similar to the voltage and current samples computations, if there exists circulating current due to paralleling of the transformer, a DFT is then performed on the circulating current samples to obtain the circulating current phasor, its polarity with respect to load voltage and its magnitude are calculated.

It is noted that after performing the DFT on the high and low load current samples and before computing the real power, if the magnitude of low gain current is less than or equal to the minimum threshold, then the high gain current phasors should be subsequently used in computing the real power whereas if the magnitude of low gain current is greater than the minimum threshold, then the low gain current phasors should be subsequently used in computing the real power. This assures that the greatest resolution of the input current will be utilized.

The real and reactive power from the voltage and current phasors are then calculated. The computation of complex power is obtainable from the voltage and current signals represented in phasor form. More particularly, with V and I representing complex phasors of voltage and current signals measured across the load, then the complex power S delivered to the load is:

$$\bar{S}=\overline{VI^*}=P+jQ=VI\cos\theta+jVI\sin\theta$$

where real power is given by the real part of $\overline{VI^*}$ and the reactive power is given by the imaginary part of $\overline{VI^*}$.

The power factor is computed as:

$$pf=\frac{P_T}{|\bar{S}|}=\frac{P_T}{\sqrt{P_T^2+Q_T^2}}$$

If there is real power above a forward power threshold, a forward power flow status is indicated whereas if the real power is less than the reverse power threshold, reverse power flow is indicated. Otherwise, if the real power is within the thresholds, the power direction is indeterminative and previous power direction is used.

If the power flow is forward, the current phasor, load voltage phasor and forward LDC resistance and reactance setpoints are used to calculate the line drop compensation (LDC). Conversely, if the power flow is reverse, the current phasor, source voltage phasor, reverse LDC resistance and reactance setpoints are used to calculate the LDC.

If there existed circulating current due to paralleling of the transformer, the amount of circulating current correction voltage is determined from the circulating current phasor and polarity.

If the non-sequential input is activated, the raise and lower timers are then reset to zero and the raise and lower LEDs and outputs are turned off.

For those tap changers that have a motor seal-in, when the input goes from off to on, the seal-in output is actuated. When the input goes from on to off, the operation count is incremented along with the keep-track of the tap position.

If there are programmed alarm relay conditions, the pickup alarm relay K1 is actuated; otherwise it is dropped out.

The computer program sets a "suspend" flag to suspend processing during tap changing. If this flag is set, processing returns to the beginning of the control logic task to refresh the watchdog timer. Otherwise, if the tap position is being kept track of internally and if the tap changer has a neutral tap position, the present tap position is set to zero (neutral). Conversely, if the tap position is known by means of an external transducer (i.e., Incon), then the present tap position is set to the value indicated by such transducer.

If the line current is equal to or above a line limit (overcurrent blocking) setpoint, then a block line limit flag is set; otherwise it is cleared. This assures that no further tap changes will occur.

If the reverse power operation is selected by the user as blocked and if the power direction is reversed, the block reverse power flag is set; otherwise it is cleared.

If the reverse power operation is to be ignored, then the setpoint pointers are set to the forward power setpoints. Otherwise, if the reverse power operation is to provide reverse regulator operation and if the power direction is forward, the setpoint pointers are set to the forward power setpoints and the local voltage is set to equal to the load voltage. Conversely, if the reverse power operation is to provide reverse regulator opertions and if the power direction is reverse, the setpoint pointers are set to the reverse power setpoints and the local voltage is set to equal to the calcualted source voltage as described above.

If the tap position is above the raise tap limit, the force lower flag and the block raise flag are both set. Similarly, if the tap position is below the lower tap limit, the force raise flag and the block lower flag are both set.

If the tap position is equal to the raise tap limit, the block raise flag is set. Similarly, if the tap position is equal to the lower tap limit, the block lower flag is set. Otherwise, the program continues.

If the local voltage is equal to or less than the block lower setpoint, the block lower flag is set. Likewise, if the local voltage is equal to or greater than the block raise setpoint, the block raise flag is set. And if the local voltage is equal to or greater than the block raise setpoint and deadband, the force lower flag is set. If the local voltage is greater than the block lower setpoint and less than the block raise setpoint, then the voltage is within limits.

The process then continues with scanning the voltage reduction inputs and communication voltage reductions command. The amount of correction voltage based upon voltage reduction amount (Volt-Red) is then computed.

The compare-setpoint-high is set to equal the active bandcenter setpoint, plus ½ of the active bandwith setpoint, less the voltage reduction (Volt-Red), less the circulating current correction voltage and less the test voltage. Similarly, the compare-setpoint-low is set to equal the active bandcenter setpoint, less ½ of the active bandwith setpoint, less the Volt-Red, less the circulating current correction voltage and less the test voltage.

If the compare-setpoint-high is equal to or greater than the compensated voltage, then band status is set to "high". Similarly, if the compare-setpoint-low is equal to or less than the compensated voltage, then band status is set to "low". Otherwise the voltage is within the band and the band status is "okay". Processing then returns to the beginning of the control logic task to refresh the watchdog timer.

Figures 1, 8F:
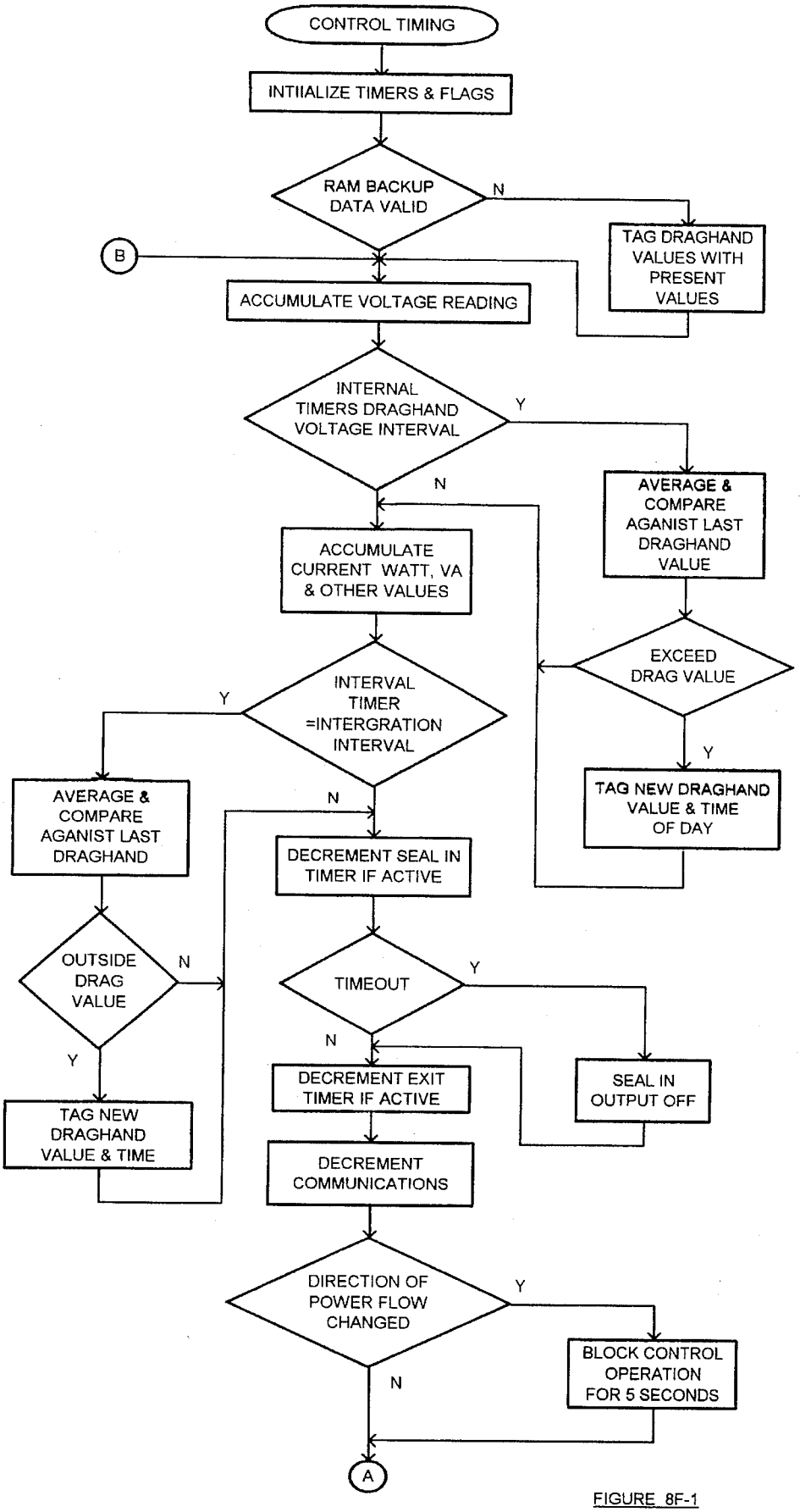
Figures 2, 8F:
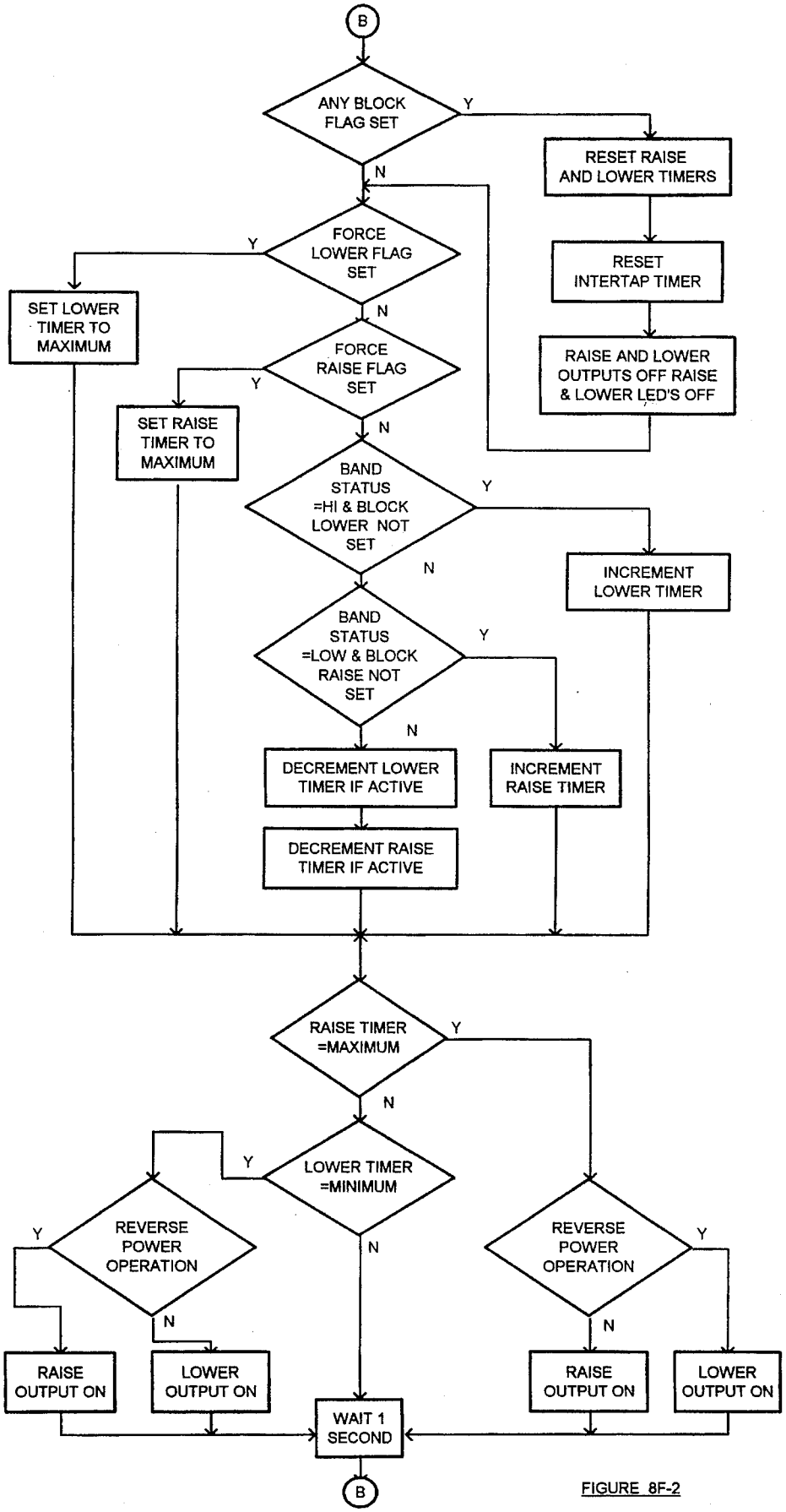

FIG. 8F is a flow diagram of the control timer task. It is executed once every second upon interruption of the microcontroller by its internal real time clock. In general, demand value calculations are performed and if the value is outside the presently stored demand draghand value, the value is updated. The present time of day is tagged along with the new demand value. The seal-in timer, communication message time out timer and the user interface timer are also updated. The intertap timer as well as the basic integrating raise and lower timer are updated. The raise and lower outputs are actuated if the corresponding timer has expired.

More particularly, as shown in FIG. 8F, this control timer task begins by initializing the timers and flags. If the RAM data values are not valid, the draghand values are updated with the present values.

The voltage readings are then accumulated. If the interval timer is equal to the draghand voltage interval, then the values are averaged and compared against the last draghand values. If the values are outside the draghand values, the new draghand values are updated along with the time of day.

The current watts, VA and other values are then accumulated.

If the interval timer is equal to the integration interval, then the values are averaged and compared against the last draghand values. If the values are outside the draghand values, the new draghand values are updated along with the time of day.

If the seal-in timer is active, it is then decremented. If it times out, then the seal-in output is turned off. Next, the exit timer is decremented if it is active. Also, if the communication lock timer is active, it is decremented.

If the direction of the power flow has changed, control operation is blocked for 5 seconds. If a block flag is set, the raise and lower and the intertap timers are reset and the raise and lower outputs and LED are turned off.

If the force lower flag is set, the lower timer is set to maximum. Likewise, if the force raise flag is set, the raise timer is set to maximum. Alternatively, if the band status is set to high and the block lower flag is not set, the lower timer is incremented and if the band status is set to low and the block raise flag is not set, the raise timer is incremented. However, if the band status is not set either way, the lower timer and the raise timer (if active) are then decremented.

If the raise timer is set to maximum and if there is reverse power operation, then the lower output is turned on; otherwise if there is no reverse power operation, the raise output is turned on. Conversely, if the lower timer is set to maximum and if there is reverse power operation, then the raise output is turned on; otherwise if there is no reverse power operation, the lower output is turned on. The processing then waits 1 second and then returns to the step of accumulating the voltages for draghand purposes.

The communication task (not flow-charted) handles the serial interface and allows all setpoints and values to be retrieved remotely. It formats data for transmission according to the defined protocol and checking for received errors. The protocol implements half duplex, serial, byte-oriented asynchronous communication. The control using this protocol assumes a slave role of a Master/Slave system. All communication to and from the controller are initiated and controlled by the host system connected to it. Each device can be assigned a unique address to allow simple networking of controls.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. Apparatus for keeping track of an electrically closed tap position in tapchanging transformers and regulators having a microprocessor based tapchanger controller; said tapchanging transformer including a tapchanging motor connectable to a power source, a group of electrically openable and closeable tap positions and a tapchanging mechanism; said tapchanging motor moving said mechanism in raise and lower directions relative to said tap positions in response to respective raise and lower commands to electrically close a tap position;

a) first and second, normally open, switching means for connecting said power source to said motor, b) said switching means closing in response to selective raise and lower commands from said controller thereby coupling said power source to said motor to move said mechanism from one tap position to another tap position in the commanded direction, c) said switching means having a high voltage state appearing thereacross when said power source is not coupled to said motor and a low voltage state appearing thereacross when the power source is coupled to said motor, d) means for detecting the voltage state across respective switching means as said motor is run, and means for determining the direction of operation of said tapchanging mechanism, e) a counter contact having at least two operating states in which a change from one operating state to the other operating state indicates movement of said tapchanging mechanism;

f) means for monitoring the number of changes of state of said counter contact and for counting the number of tap-changes; and g) means for logically combining the direction of tapchanging mechanism operation and the indication of a change in said counter contact operating state, whereby the apparatus keeps track of the electrically closed tap position.

2. Apparatus as in claim 1 further including means for initializing said tap position identifier.

3. A tapchanger controller as in claim 2 further including a neutral tap position contact input, said neutral tap position contact input closing when the tapchanger is on a neutral position, means for resetting said tap position identifier to neutral whenever said neutral tap position contact closes.

4. Apparatus as in claim 1, further comprising a) a controller chassis having a front panel and a display means, b) said front panel including button interface means, and c) said microprocessor developing a test voltage screen on said display means in response to manipulation of said button interface means to enable a bias voltage to be set to modify the measured voltages at said tap positions, whereby said tapchanger controller is caused to effectively change said tapchanging mechanism for testing without altering any actual settings of said apparatus.

5. Apparatus for keeping track of an electrically closed tap position in tapchanging transformers and regulators having a microprocessor based tapchanger controller; said tapchanging transformer including a tapchanging motor connectable to a power source, a group of electrically openable and closeable tap positions and a tapchanging mechanism; said tapchanging motor moving said mechanism in raise and lower directions relative to said tap positions in response to respective raise and lower commands to electrically close a tap position;

a) raise and lower switches for connecting said source of power to said motor to thereby move said mechanism from one tap position toward a new tap position in response to a command, said switches being normally open and non-conducting, b) means for providing a unique identifier corresponding to each tap position, c) first raise and lower opto-isolators responsive to input command parameters to turn on the respective raise and lower switches to couple power to said motor, d) raise and lower rectifier and filter circuitry connected to said respective raise and lower switches and providing a high voltage state when voltage from said source of power exists across a switch thereby indicating power is not coupled to said motor, and said raise and lower rectifier and filter circuitry providing, within a preset time, a low voltage state when the voltage across the respective raise and lower switch drops to a lower level thereby indicating power is coupled to said motor, e) second raise and lower sensing opto-isolators, said raise and lower rectifier and filter circuitry being connected to said second respective raise and lower sensing opto-isolators to turn OFF said second sensing opto-isolators when said rectifier and filter circuitry provides a low voltage state thereby detecting that the motor has been energized to move said mechanism, f) a counter contact having at least two operating states in which a change from one operating state to the other operating state indicates movement of said tapchanging mechanism, g) means for providing an indication of the state of said counter contact as said mechanism moves from one tap position to another tap position, h) means for monitoring the ON-OFF states of said second raise and lower sensing opto-isolators to determine the direction of tapchange, and i) means for logically combining the outputs of said second raise and lower opto-isolators and transition information from said counter contact state to update the initial closed tap position to the new tap position whereby the identity of each electrically closed tap position is known.

6. A method for keeping track of an electrically closed tap position of a tapchanging system in a transformer and regulator, said system including electrically openable and closeable voltage tap positions, a tapchanging mechanism driven by a tapchanging motor, switching means selectively connecting to said motor to move said mechanism in respective raise and lower directions, a counter contact having two operating states, said method consisting of the steps of:

a) selectively energizing said raise and lower switching means to cause movement of said mechanism from a closed tap position toward a new tap position such that the tapchanging transformer and regulator provides a desired output voltage, b) detecting a change in voltage across said energized switching means and determining the direction of movement of said tapchanging mechanism by said change in voltage, c) providing a unique identifier corresponding to each tap position, d) counting the number of changes of state of said counter contact as said mechanism moves from a closed tap position to a new tap position, and d) logically combining the direction of tapchanging mechanism movement, and the number of changes of state of said counter contact, whereby said apparatus keeps track of the closed tap position.

7. A method for operation of a system including an autotransformer wherein power flow can be in a forward or reverse direction, said autotransformer having a tapped series winding comprising a group of openable and closeable tap positions, a microprocessor based controller receiving inputs from a voltage transformer, a motor driven tapchanging switching mechanism connected to said controller, and said controller including an assembly for keeping track of the closed tap positions, said method comprising the following steps:

a) combining a measure of output voltage and a measure of output load current and determining the direction of flow of real power through said autotransformer, b) reversing the direction of motor response upon determination of a reversal of real power flow through said autotransformer, c) entering impedance data for said autotransformer into said controller, d) obtaining the resultant of the following parameters: said closed tap position, said measure of voltage, said measure of current, said autotransformer impedance data, and said determination of reversal of direction of power flow to ascertain the actual voltage into which said power is flowing, and e) operating said motor to select a tap position to regulate the output voltage to a pre-selected value.

8. A method as in claim 7 further including the steps of:

a) entering into said controller a first set of voltage and line drop compensation setpoints for use with power flowing in a first direction, b) entering into said controller a second set of voltage and line drop compensation setpoints for use with power flowing in a second direction, c) operating said motor for selecting said autotransformer tap positions to regulate the voltage using the respective setpoints for said first and second directions of power flow.

9. A method of paralleling tapchanging transformers and regulators using a circulating current method consisting of the steps of:

a) acquiring samples of the circulating current in said paralleled transformers, b) performing a discrete Fourier transform on the circulating current samples to obtain circulating current phasors, c) calculating the magnitude and polarity of said circulating current after scaling, d) calculating a correction voltage representative of said circulating current from the circulating current phasor and polarity, and e) moving the tap position in response to said correction voltage in a direction so to minimize the circulating current.

10. A method of operation of a system processing alternating current (AC) electrical power, said system including a tapchanging transformer having a tapped series winding comprising a group of openable and closeable tap positions, a microprocessor based controller for receiving voltage inputs from a voltage transformer, and a unipolar analog to digital converter means having a low and a high voltage reference means for receiving analog alternating current signals at the power frequency, said method consisting of the steps of:

a) obtaining periodic digital samples of said AC signals for one polarity of said AC signals and zeros for a second polarity and thereby forming samples of a modified signal related to said AC signals and conveying said samples to said processor, b) performing a discrete Fourier transform on said modified AC signals and obtaining real and imaginary phasor components of the fundamental component of said modified signal, c) obtaining the amplitudes of said modified AC signals and the phase angles between any two said AC signals, and d) multiplying said amplitudes by two and obtaining the amplitudes of the corresponding unmodified AC signals.

* * * * *